United States Patent [19]

Brooks

[11] 4,436,157

[45] Mar. 13, 1984

[54] LATCH MECHANISM FOR SUBSEA TEST TREE

[75] Inventor: Robert T. Brooks, Kingwood, Tex.

[73] Assignee: Baker International Corporation, Orange, Calif.

[21] Appl. No.: 291,009

[22] Filed: Aug. 7, 1981

Related U.S. Application Data

[63] Continuation-in-part of Ser. No. 64,332, Aug. 6, 1979, Pat. No. 4,320,804.

[51] Int. Cl.[3] ..... E21B 43/12; E21B 34/10

[52] U.S. Cl. ..... 166/344; 166/375; 166/364; 166/332

[58] Field of Search ..... 285/18, 319, DIG. 21; 166/72, 322, 323, 331, 332, 334, 336, 340, 344, 363, 364, 374, 375

[56] References Cited

U.S. PATENT DOCUMENTS

| | | | |
|---|---|---|---|
| Re. 27,464 | 8/1972 | Taylor, Jr. | 166/362 |
| 3,870,101 | 3/1975 | Helmus | 166/363 |
| 4,062,406 | 12/1977 | Akkerman et al. | 166/323 |
| 4,077,473 | 3/1978 | Watkins | 166/323 |
| 4,161,960 | 7/1979 | Watkins | 166/323 |
| 4,294,315 | 10/1981 | Yonker et al. | 166/322 |

*Primary Examiner*—Stephen J. Novosad
*Assistant Examiner*—William P. Neuder
*Attorney, Agent, or Firm*—Norvell & Associates

[57] ABSTRACT

A test assembly is provided for incorporation within a blowout preventer stack above a subterranean well and provides inner and outer latching connections between upper and lower portions of a tubular conduit extendible to a production zone within the well. The test assembly has valve means in the lower conduit portion manipulatable between open and closed positions by a reciprocable actuator to control flow of fluid within the conduit. Retaining means are provided for each of the inner and outer latches to insure that such latches may not be disengaged when the valve means is in other than an open position. The retaining means are operable by either the application of fluid pressure or through mechanical manipulation of the tubing string to be shifted to a non-retaining position relative to both the inner and outer latches, thus permitting selective disconnection and reconnection of the upper and lower portions of the tubular conduit.

10 Claims, 36 Drawing Figures

LATCH MECHANISM FOR SUBSEA TEST TREE

CROSS-REFERENCE TO RELATED APPLICATION

This application is a continuation-in-part of my copending patent application, Ser. No. 64,332, filed Aug. 6, 1979, and entitled "SUBSEA TEST TREE", now U.S. Pat. No. 4,320,804, assigned to the same assignee as this application.

BACKGROUND OF THE INVENTION

1. Field of the Invention

This invention relates to an apparatus for performing well bore tests, and more particularly to subsea well bore test apparatuses adapted to be located in a blowout preventer stack.

2. Description of the Prior Art

A removable subsea test tree is well known to those skilled in the art and is adapted to be located in a blowout preventer stack which has an upper releasable latch assembly to permit the drill pipe or other tubular string above the test tree to be released from the valve portion when the latter is in a closed condition, permitting removal of the tubular string thereabove and the temporary abandonment of the well in the event that high seas or inclement weather makes it necessary, or desirable, to do so. More specifically, one or more valves are placed in an open condition by fluid pressure pumped down a hydraulic control line extending from a drilling vessel to the tree disposed in the blowout preventer stack. Other hydraulic pressure control lines extend from the drilling vessel to the releasable connection. When pressure is applied through the line, the connection is released.

Typical of the prior art is U.S. Pat. No. 3,870,101 entitled "Removable Subsea Production Test Valve Assembly" which includes one or more ball valves which are pressure actuated to open position from the vessel or platform to permit well testing, and also an upper latch mechanism releasably secured to the valve portion of the assembly. Relieving of the pressure effects closing of one or more valves, permitting the latch mechanism to be released and removed with the upper portion of the tubing or drill pipe string to the vessel or platform. The pistons controlling the valves are pressure balanced, with the valves being adapted to permit reverse flow around them when in closed condition. A pressure actuated piston capable of forcing a lower ball valve to closed position is provided which, in so doing, cuts a wireline which may have parted above the assembly, and which would otherwise hold the ball valve open.

U.S. Pat. No. Re. 27,464 disclosed a similar device which specifically incorporates plural ball valve elements and a selectively releasable latch element. U.S. Pat. No. 3,457,991 discloses a similar concept.

U.S. Pat. No. 3,071,188, discloses a remotely controlled latch mechanism which is hydraulically activated, and which may be used in conjunction with one or more valve elements in a conventional test tree apparatus. A similar latch mechanism is disclosed in U.S. Pat. No. 3,102,591.

U.S. Pat. No. 3,256,936 also discloses an apparatus and a method of completing a subsea well incorporating a prior art subsea test tree apparatus.

SUMMARY OF THE INVENTION

The present invention is directed to an improved latch assembly for use in a test assembly secureable within a blowout preventer stack above a subterranean well and carriable between upper and lower portions of a tubular conduit extendable to at least one production zone within the well for controlling fluid flow through the conduit during the testing of the well, and the like. The present invention provides both an inner and an outer latch in such latch assembly. Such latch assembly permits fluid pressure operation thereof to release such latches only subsequent to the closing of the two ball valves. Moreover, the operating mechanism for both the inner and outer latches can be mechanically manipulated to release the latches and permit the separation of the upper and lower conduit portions while the two ball valves remain in their closed positions relative to the lower fluid conduit portion remaining in the tree.

BRIEF DESCRIPTION OF THE DRAWINGS

FIGS. 12A-1 and 12A-2 are a longitudinal sectional view illustrating the camways and the valve assemblies prior to manipulation to open the ball valves.

FIGS. 12B-1 and 12B-2 are views similar to that of FIGS. 12A-1 and 12A-2 illustrating the positioning of the ball camway pins of the valve assemblies within the camways subsequent to initial shifting of the sleeve to equalize pressure across the upper ball valve.

FIGS. 12C-1 and 12C-2 are views similar to that of FIGS. 12B-1, and 12B-2 illustrating the positioning of the upper and lower ball valve pins within their respective camways, with the upper ball valve being rotated to the completely open position.

FIGS. 12D-1 and 12D-2 are views similar to that of FIGS. 12C-1 and 12C-2 with the pin of the upper ball valve assembly traveling within its long camway portion without affecting the positioning of the ball valve, and the lower ball valve pin traveling within its long camway portion to remove the ball valve from its upper seal for press equilization thereacross.

FIGS. 12E-1 and 12E-2 are views similar to FIGS. 12D-1 and 12D-2 illustrating positioning of the upper and lower ball valve pins within their respective camways, and the lower ball valve being completely manipulated to open position.

FIGS. 12F-1 and 12F-2 illustrate the final position of the manipulation of the ball valves to open position, illustrating the positioning of the upper and lower ball valve pins within their respective camways for locking of the balls within the respective camways.

DESCRIPTION OF THE PREFERRED EMBODIMENTS

Figure 1:
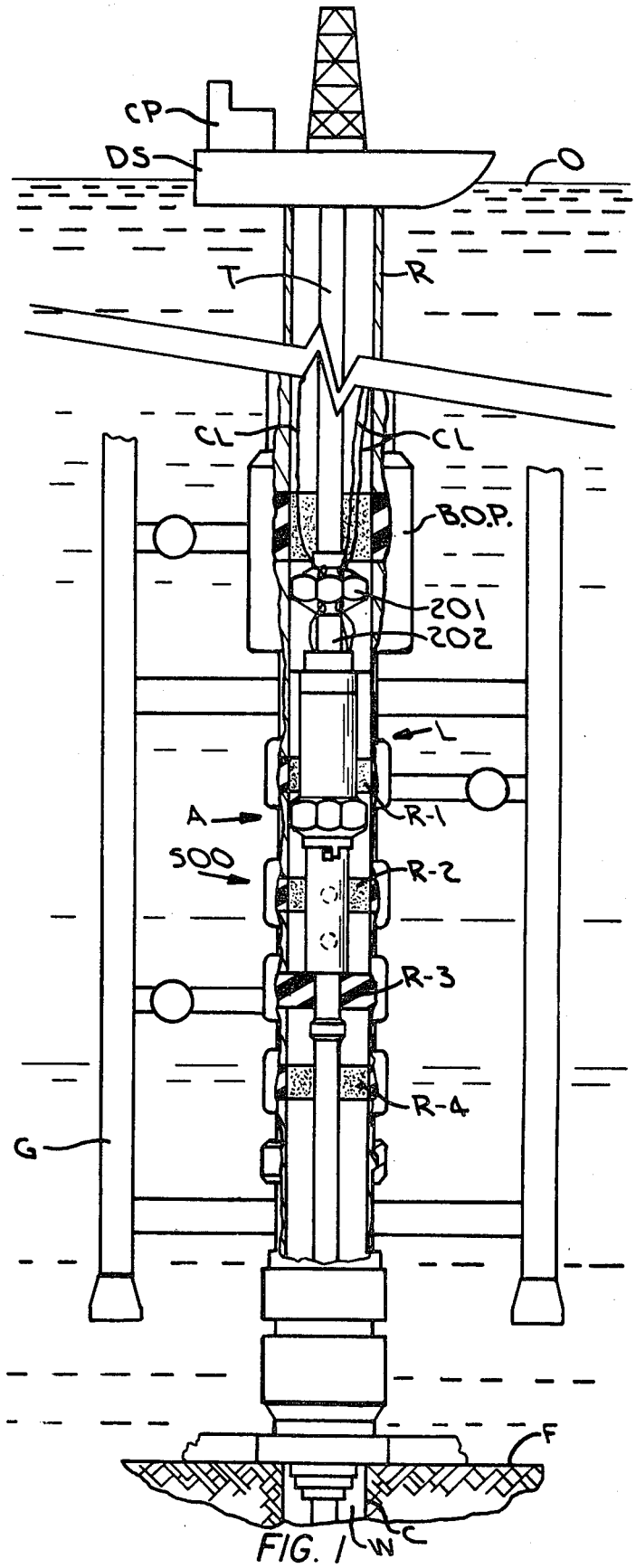
FIG. 1 is a schematic illustration of the apparatus of the present invention affixed on a tubing string within a riser and housed within a blowout preventer stack affixed to the well above the floor of the seabed.

Referring now to FIG. 1, the apparatus A, generally comprising two components: a latch L, and a ball valve assembly 500, is landed within a guide (not shown) above the seabed F and communicates to a well W. The apparatus A is carried on tubing T within a riser R extending below a drill ship DS on the ocean O, the tubing T being carried below the apparatus A into the well W within the casing C. Control lines CL extend from the control panel CP on the drill ship DS to the apparatus A for hydraulic manipulation of the ball valve assembly 500 and the latch L. A centralizer 201 on the upper stinger body 202 of the apparatus A guides the apparatus A within the riser R and through an upper blowout preventer BOP. Upper, central and lower pipe rams, R-2, R-3 and R-4 are respectively engaged around the exterior of the apparatus A and the tubing T extending therebelow, to prevent fluid communication between the riser R and the apparatus A thereabove, and to control the fluid flow within the well W. Shear rams R-1 are also provided exterior of the apparatus A for additional protection.

Now referring to FIGS. 3A, 3B and 3C, the apparatus A generally comprises an outer housing 100, an inner stinger 200 initially carried therein, a central collet or outer latch assembly 300 carried between the inner stinger 200 and the outer housing 100, and a ball valve cartridge assembly 400 carried below the upper portion of the inner stinger 200 and within the lower portion of the stinger receptacle.

The outer housing 100 is defined at its uppermost end by an upper torque sub 101 receiving therethrough a torque pin 102 extending within a bore 217 of the inner stinger 200 such that, prior to shearing of the pin 102, the outer housing 100 and the inner stinger 200 are rotationally interengaged. An O-ring 103 is circumferentially carried within its groove on the upper torque sub 101 to prevent fluid communication between the upper torque sub 101 and the main control housing 209 of the inner stinger 200. A seal 104 also is carried circumferentially interiorly of the torque sub 101, and is a dynamic seal, which is slidably received upon the exterior of a latch safety piston 301 of the central collet or outer latch assembly 300. The upper torque sub 101 is secured at threads 105 and by a lock screw 106 to a longitudinally extending central cylindrical body portion 107 of housing 101 having rotation resisting lugs 108 welded thereon and peripherally extending within a key-way 307 of the central collet or outer latch assembly 300. The lug 108-key-way 307 interengagement is activated during rotation of the tubing T to mechanically disengage the central collet or outer latch assembly 300.

Upper and lower ports 109 and 110 are defined through the central body 107 to permit pressure equalization between the exterior and the interior of the central body 107. The central body 107 also has an inner smooth wall 117 preventing expansion of the lock sleeve 313 of the central collet or outer latch 300 and interengaging the outer smooth surface of the sleeve during the unlatching procedure.

The central body 107 is secured by means of threads 111 and screws 112 to a lower torque sub 113. Stop extensions 114 spaced 180° apart define the lowermost end of the torque sub 113 and engage the outwardly extending companion lugs 268A–268B of the ball cartridge housing 268 during initial rotation of the outer housing 100 and the inner stinger 200, during the procedure to mechanically unlatch the apparatus A.

A threaded connector 115 is profiled on the exterior of the lower torque sub 113 and defines a passage therethrough for transmission of chemical inhibitor, and the like from a line (not shown) communicable to the passage 116 when affixed within the connector 115. Circumferentially extending elastomeric O-ring seal elements 118 and 119 are interiorly carried around the lower torque sub 113 to prevent fluid communication between the sub 113 and the ball cartridge housing 268 and prevent leakage of inhibitor fluid.

Figure 7:
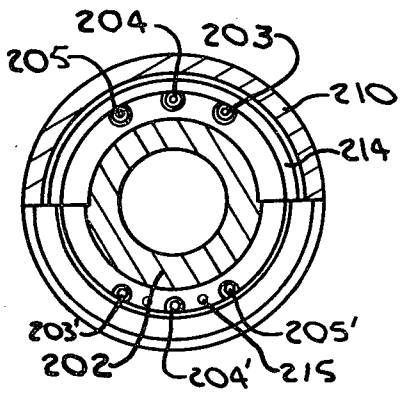
FIG. 7 is a cross-sectional view taken along line 7—7 of FIG. 3A.
Figure 11:
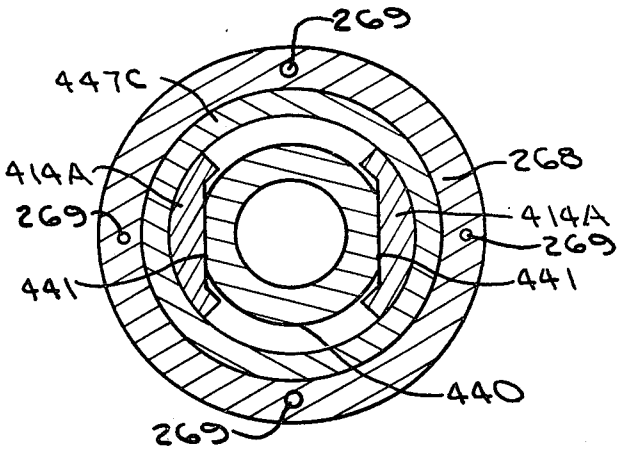
FIG. 11 is a cross-sectional view taken along line 11—11 of FIG. 4C.
Figure 10:
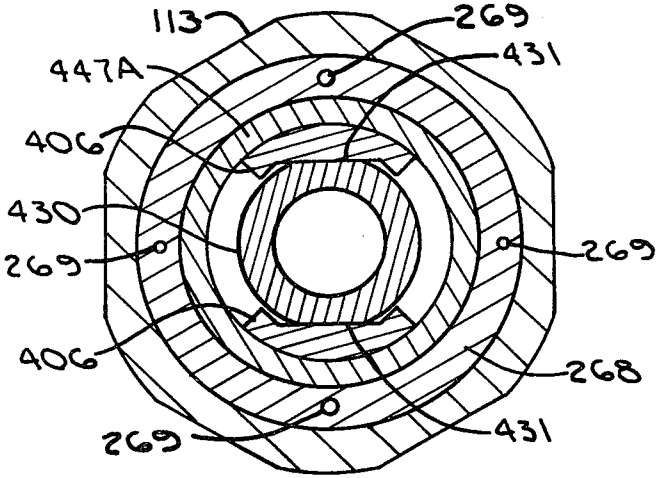
FIG. 10 is a cross-sectional view taken along line 10—10 of FIG. 4B.

The inner stinger body 200 is contained for the most part within the outer housing 100 and generally defines that portion of the apparatus A which, together with the outer housing 100, is selectively disengageable from the component parts of the apparatus A therebelow. A guide 201 extends exteriorly upwardly from the inner stinger body 200 and is affixed thereto at threads 201D for manipulation of the apparatus A within the riser R. The guide 201 has a plurality of longitudinally extending passageways 201C therethrough, each passageway having an upper port 201A and a lower port 201B. The passages 201C together receive three hydraulic control lines one line extendible through each passage from the control panel CP on the drill ship DS. The first hydraulic control line 203 (FIG. 4A) is functional during manipulation of the ball valve assemblies to open position; the hydraulic control line 204 (FIG. 3A) being utilized to manipulate the ball valves to the closed position: and the hydraulic control line 205 (FIG. 5A) being utilized during hydraulic unlatching of the central collet or outer latch assembly 300 from the other component parts of the apparatus A. The control lines 203, 204 and 205 are respectively affixed to companion lines extending from the control panel CP by means of quick disconnect couplings 206, with the lines extending therefrom and into the inner stinger 200 through a bore 213 defined through a retainer sub 210 and a clamp plate 214 (FIG. 7). Each line extends within the bore 213 and is received within a line bore 209A in the main control housing 209, the main control housing 209 being secured at threads 207 to the retainer sub 210. A screw 212 is inserted within its bore 211 for additional securement between the retainer sub 210 and the main control housing 209 of stinger 200. The main control housing 209 also receives a plurality of screws 215 (FIG. 7) spaced between the bores 213 for engagement of the clamp plate 214 to the main control housing 209.

Spaced 180° away from each of the respective lines 203, 204 and 205 are a series of vent passages 203'', 204'' and 205'' which are utilized to remove air from the companion passages 203, 204 and 205 prior to complete assembly of the apparatus A. The passages receive plugs 203', 204' and 205' which are respectively inserted through the clamp plate 214 and the retainer sub 210 within the respective vent passages, each of the plugs being sealingly engaged within the respective passage.

A thrust bearing 216 is carried around the lowermost exterior of the retainer sub 210 and has its lower face contacting the uppermost face of the upper torque sub 101. The use of the thrust bearing 216 prevents galling between the inner stinger 200 and the outer housing 100 as a result of set down weight being applied through the tubing T during the mechanical unlatching procedure, described below.

A transverse bore 217 is defined within the main control housing 209 of stinger 200 somewhat below the thrust bearing 216 for receipt of the torque pin 102 which is carried within the upper torque sub 101.

Figure 4A:
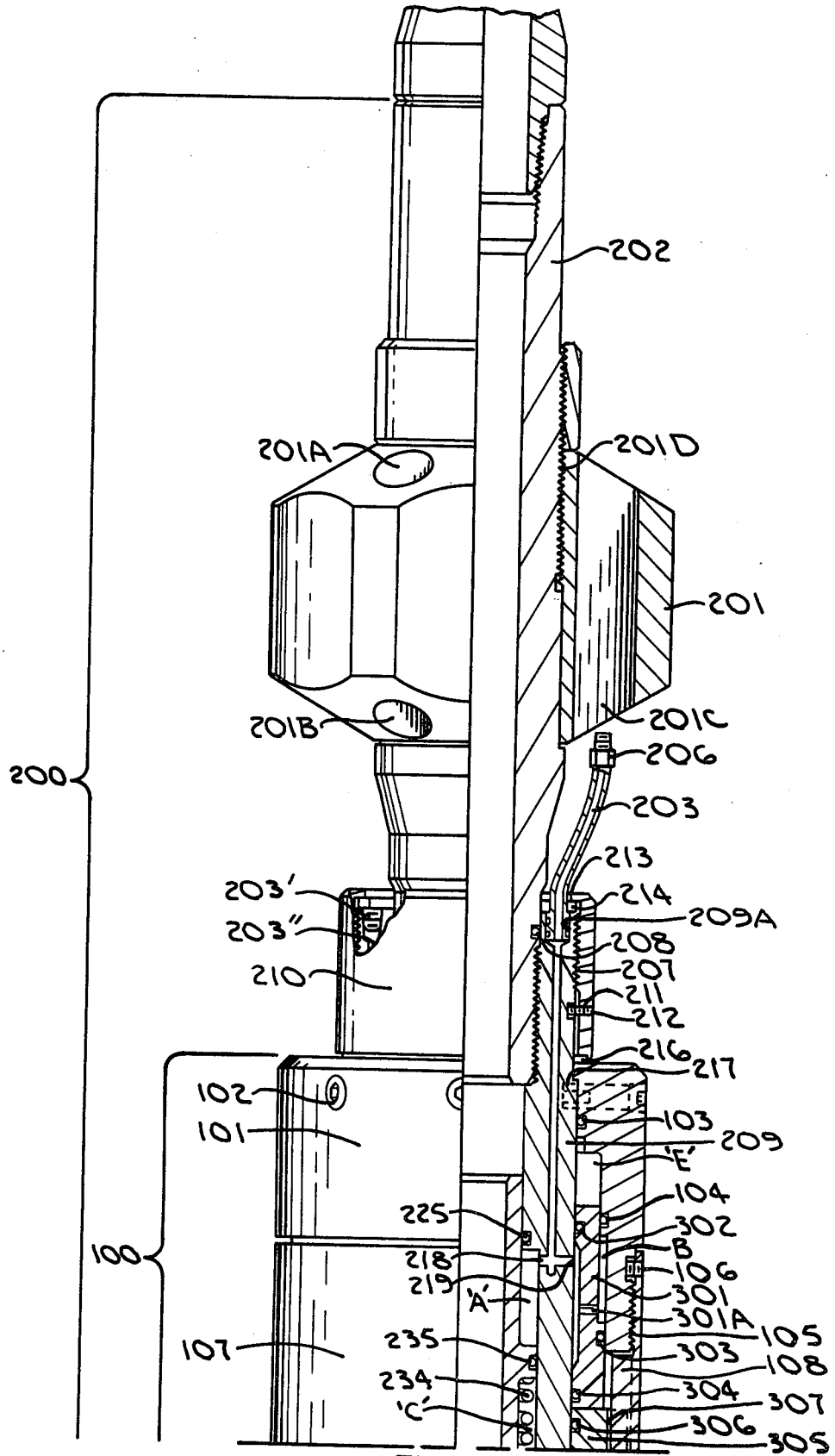
FIGS. 4A, 4B and 4C also together constitute a longitudinally extending sectional view of the apparatus of the present invention, in the position as illustrated in FIG. 2B.

As shown in FIG. 4A, a port 218 is transversely bored through the main control housing 209 and terminates the passage 203 into the chamber 'A' above the seal 235 on the ball operator piston 236. Additionally, the passage 203 extends to a port 219 in the main control housing 209 which, in turn, communicates through a passage portion 301A in the latch safety piston 301 to a piston chamber 'B' thereabove. The passage 203 is used to shift the cooperating elements downwardly to manipulate the ball elements to the open position.

Now referring to FIGS. 3A and 3B, the passage 204 communicates to port 220 and to a chamber 'C' between the ball operator piston 236 and the main control housing 209 during the ball valve closing procedure described below. The passage 204 also communicates to a port 221 and to a chamber 'D' below a seal 252A on the inner latch piston 251 to maintain the spring retainer 248 snugly against the latch 241 to prevent inadvertent disengagement between the latch finger 242 and the latch receptacle 401. The passage 204 also extends to a port 222 and to a chamber 'E' above the outer latch safety piston 301 to urge the piston 301 downwardly to assure against inadvertent upward shifting of the outer latch housing 309 during rotation of the ball valves to the closed position.

Figure 5A:
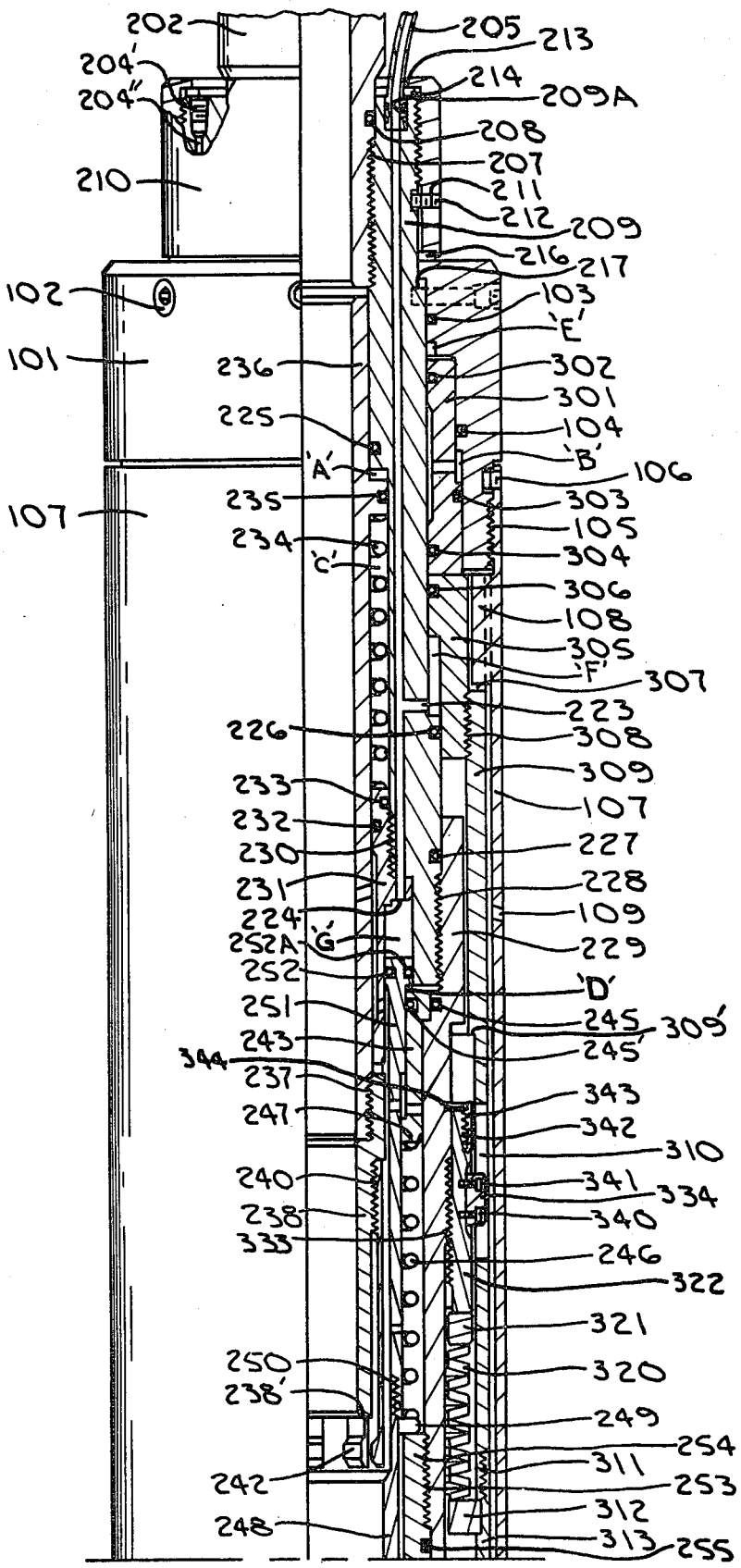
FIGS. 5A and 5B together constitute a longitudinally extending sectional view of the upper portion of the apparatus in the unlatched position.
Figure 5B:
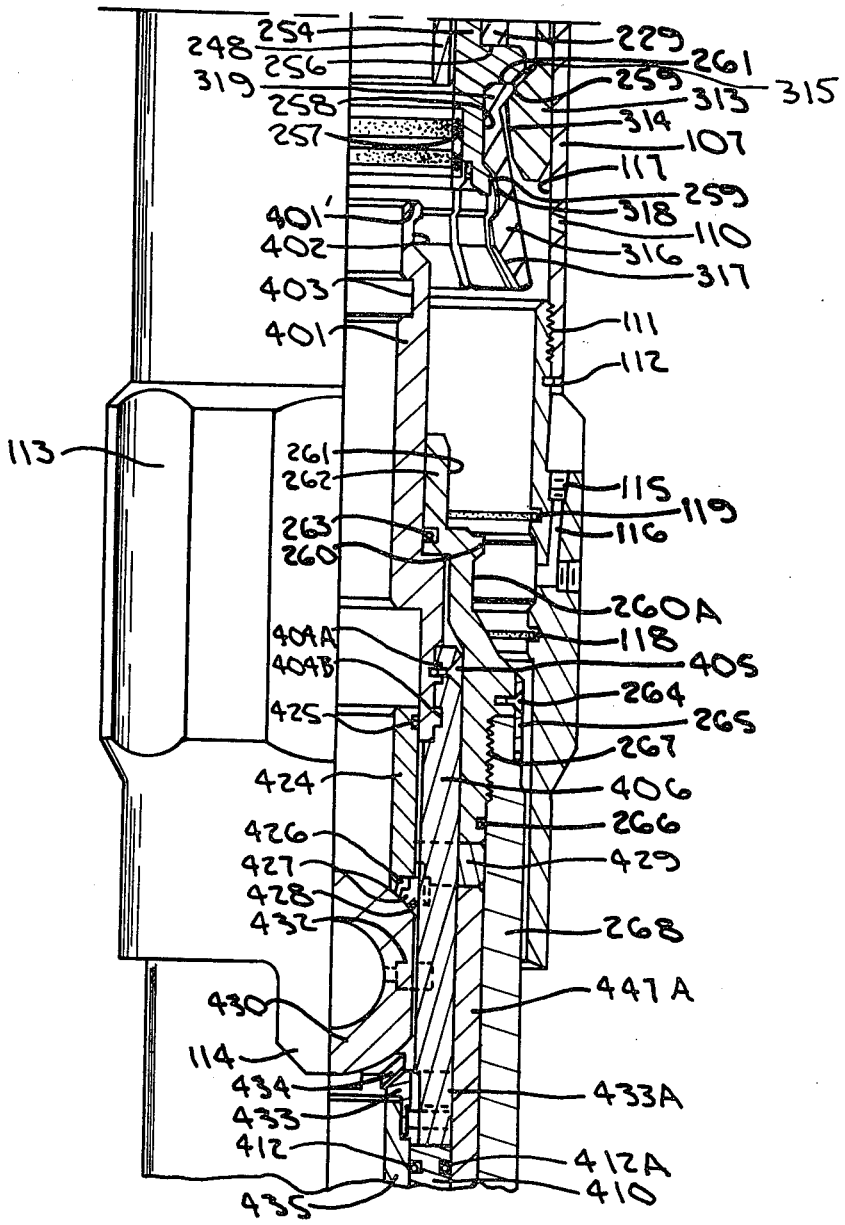

As illustrated in FIGS. 5A and 5B, passage 205 is utilized during hydraulic unlatching and relatching of the apparatus A and communicates to a port 223 and a chamber 'F' defined above a seal 226 on the main control housing 209 to hydraulically shift the outer latch piston 305 and the latch housing 309 affixed thereto to their uppermost position to effect the unlatching of the collet or outer latch assembly 300. The passage 205 also communicates to a port 224 and a chamber 'G' defined above the seals 252 and 252A on the inner latch piston 251 for urging the latch piston 251 downwardly and away from the fingers 242 of the latch 241 during the unlatching procedure described below.

An elastomeric seal 225 is carried exteriorly around the main control housing 209 to prevent fluid communication between the housing 209 and the ball operator piston 236 longitudinally extending interiorly thereof. The seal 225 also defines the uppermost end of the chamber 'A'. A similar seal element 226 is exteriorly carried around the main control housing 209 to prevent fluid communication between the housing 209 and the outer latch piston 305. The seal 226 defines the lowermost end of the piston chamber 'F'.

An elastomeric seal 227 also is carried on the main control housing 209 of stinger 200 to prevent fluid communication between the housing 209 and the latch lock spring housing 229 carried by threads 228 at its uppermost end. A cylindrically defined elongated spring retainer 231 is carried on the main control housing 209 and is secured thereto by threads 230. An O-ring seal 232 is interiorly carried around the spring retainer 231 to prevent fluid communication between the retainer 231 and the ball operator piston 236. Similarly, an O-ring 233 is carried exteriorly around the uppermost end of the spring retainer 231 to prevent fluid communication between the retainer 231 and the main control housing 209. Additionally, the elastomeric seal rings 232-233 define the lowermost end of the chamber 'C', as shown in FIG. 3B.

A coiled piston return spring 234 is housed within the chamber 'C' and has its uppermost end resting upon the piston head of the ball operator piston 236, while its lowermost end rests upon the upper end of the return spring retainer 231. The piston return spring 234 urges the ball operator piston 236 upwardly during the unlatching procedure to remove the latch fingers 242 from engagement with the latch receptacle 401.

Figure 3A:
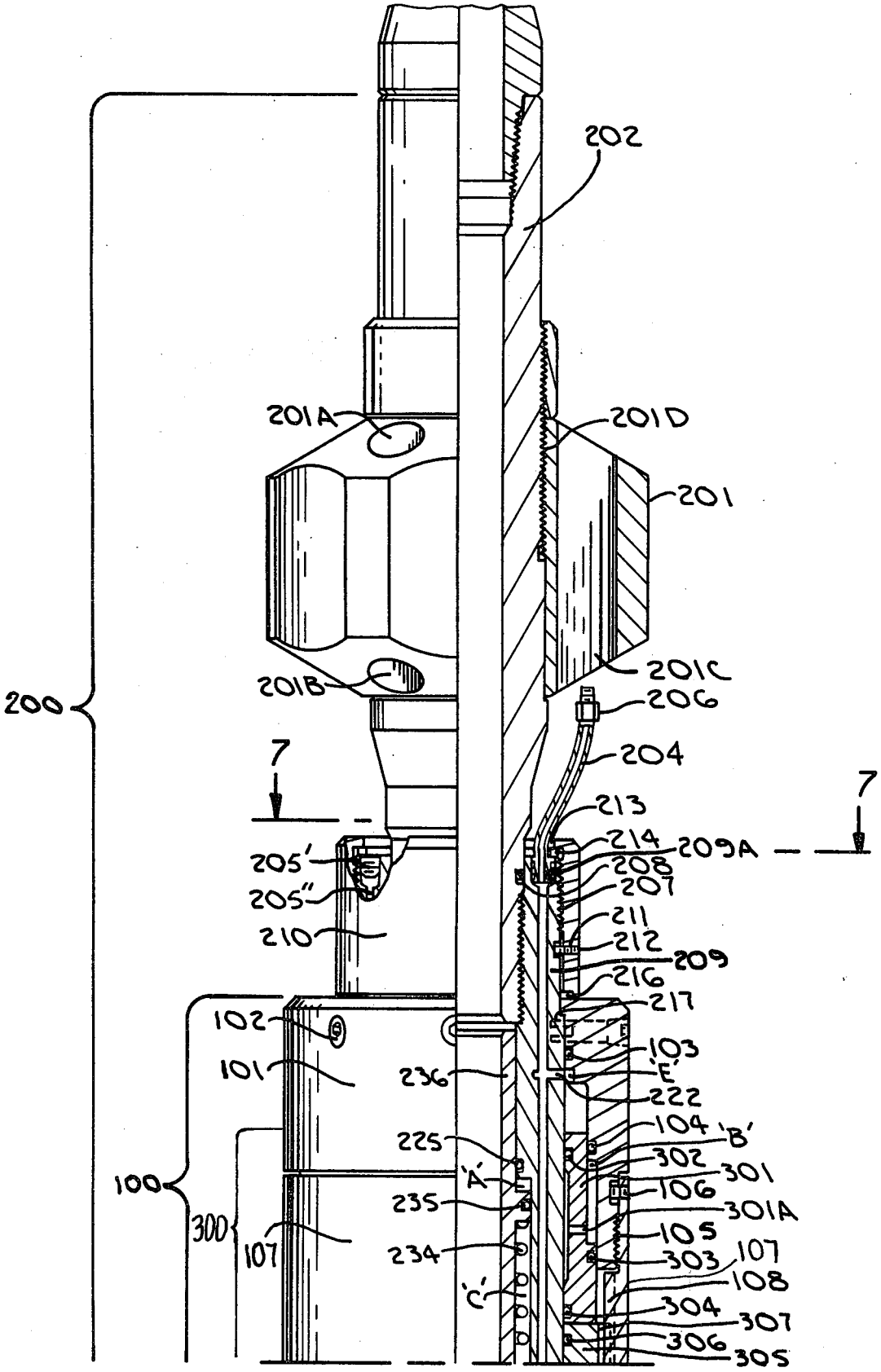
FIGS. 3A, 3B, and 3C together constitute a longitudinally extending sectional view of the apparatus of the present invention in the position as illustrated in FIG. 2A.
Figure 3B:
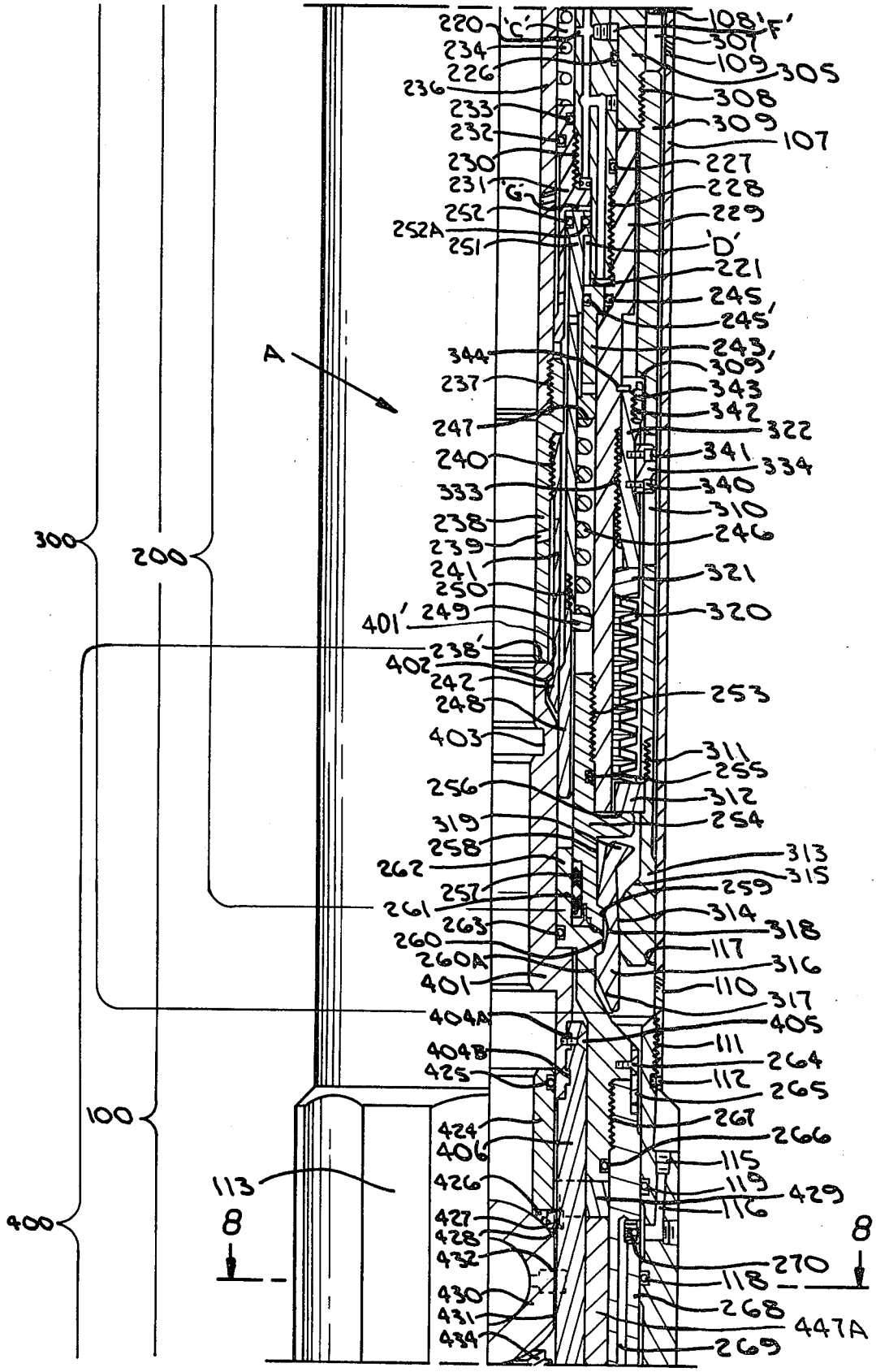
Figure 3C:
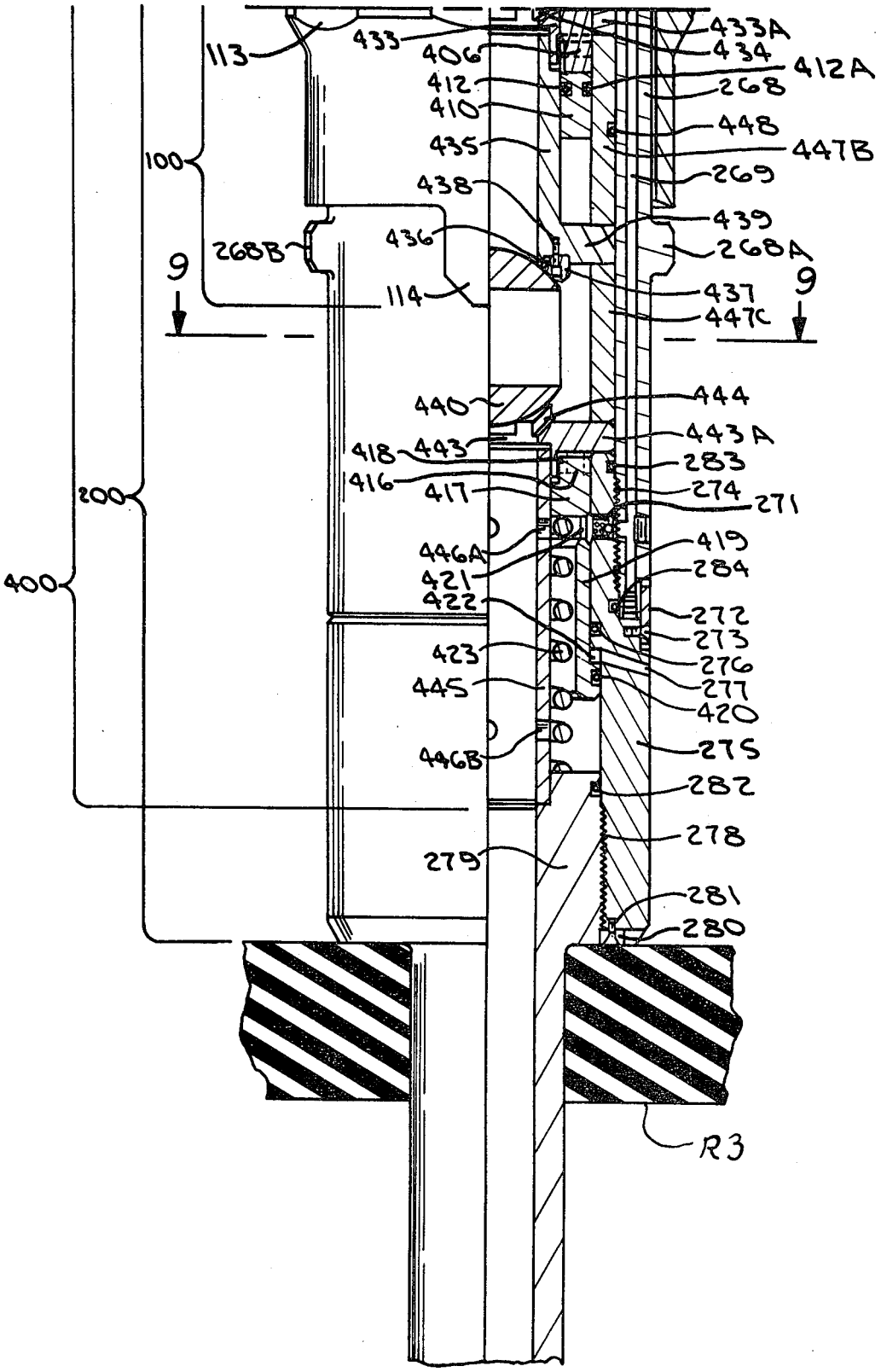

An elastomeric O-ring seal 235 is exteriorly carried around the circumference of the head of the ball operator piston 236, and defines the uppermost end of the chamber 'C', as shown in FIG. 3A.

The ball operator piston 236 is secured by threads 237 to a latch mandrel 238 therebelow having a port 239 transversely extending therethrough to permit transmission of well or other fluids for pressure equilization purposes. Affixed to the latch mandrel 238 by threads 240 are a series of exteriorly and circumferentially extending latch elements 241, each latch element having inwardly facing finger elements 242 for selective engagement on a companion groove 402 on the latch receptacle 401 when the inner stinger body 200 is secured within the apparatus A to the ball valve cartridge assembly 400.

A stop sleeve element 243 is carried between the inner latch piston 251 and the latch lock spring housing 229 and securely rests upon a shoulder of the latch lock spring housing 229. The stop sleeve 243 carries an inner seal element 245' to prevent fluid communication between the stop sleeve 243 and the latch piston 251. Additionally, this seal 245' defines the lowermost end of the chamber 'D', as shown in FIG. 3B. The stop sleeve 243 receives the uppermost end of a latch sleeve return spring 246 on its lower face 247, the lowermost end of the spring 246 resting upon a shoulder 249 of the inner latch piston 251. The latch sleeve return spring 246 urges the inner latch piston 251 and a latch retainer 248 in a downward position such that the latch retainer 248 is secured adjacent the fingers 242 of the latch 241 to maintain the fingers 242 within the groove 402. A seal element 245 is carried at the uppermost exterior end of the stop sleeve 243 to prevent fluid communication between the sleeve 243 and the latch lock spring housing 229.

The inner latch piston 251 is normally urged downwardly by the latch sleeve return spring 246 to its unlatched position shown in FIG. 5A, but may be shifted upwardly when pressure is increased within the chamber 'D', a seal element 252A being carried in a head portion of the latch piston 251 to define the uppermost end of the chamber 'D'.

The outer latch lock spring housing 229 is secured by threads 253 to a latch finger upper receptacle 254 which receives the fingers 316 of the central collet or outer latch assembly 300. An elastomcric ring 255 is carried exteriorly around the receptacle 254 to prevent fluid communication between the receptacle 254 and the housing 229. An outwardly extending upper shoulder 256 is defined on the latch finger upper receptacle 254 and normally receives the spring retainer 312 which is urged toward interface with the shoulder 256 by the belleville spring 320 of the central collet or outer latch assembly 300. A series of upper and lower facing chevron-type seal elements 257 are carried circumferentially and interiorly around the latch finger upper receptacle portion 254 of stinger 200, the seals 257 being receivable upon a smooth latch finger lower receptacle 262 when the inner stinger 200 is secured within the receptacle 254 and other components defining the apparatus A. Thus, two annular locking shoulders 260B and 259B are placed in axial proximity when stinger body 200 is fully inserted in receptacle 262. Latch fingers 316 hold such shoulders in locked engagement.

An elongated smooth unlatching groove 258 is exteriorly defined upon the latch finger upper receptacle 254 for receipt of the uppermost portion 319 of the fingers 316 when they are urged into disengaging position relative to the groove 260A and shoulder 260B of the apparatus A. The latch finger upper receptacle 254 also defines a protruding upper rocker section 259 which, when interengaged with the lower rocker section 260, provides a dome-like receptacle for the fingers 316 as they are secured within the groove 260A.

The latch finger lower receptacle 262 has a smooth wall 261 for sealing engagement with the chevron-like seals 257 to assure pressure integrity of the interior of the apparatus A when the inner stinger 200 is affixed therein. An elastomeric seal element 263 is carried interiorly around the latch finger lower receptacle 262 to prevent fluid communication between the receptacle 262 and the ball valve actuator 401.

An elongated ball cartridge housing 268 is secured to the lowermost end of the latch finger lower receptacle 262 by means of threads 267. Additionally, keys 265 are secured between the housing 268 and the receptacle 262 in key slots by screws 264. An O-ring seal element 266 is carried exteriorly around the lowermost end of the receptacle 262 to prevent fluid communication between the latch finger lower receptacle 262 and the ball cartridge housing 268.

First and second outwardly protruding stop lugs 268A and 268B (FIG. 3C) are carried exteriorly on the ball cartridge housing 268 for selective rotational interface with the stop extension 114 of the outer housing 100 during mechanical unlatching of the inner stinger 200 or rotation of the tubing string T. An elongated passageway 269 is provided within the ball cartridge housing 268 with a check valve 270 carried at the uppermost end thereof and a similar check valve 271 carried at the lowermost end thereof, the passageway 269 communicating with the passage 116 in the lower torque sub 113 to transmit liquid inhibitor, or the like, to the interior of the apparatus A, thence to the top of the well through the tubing T.

A piston housing element 275 is secured to the ball cartridge housing 268 by means of threads 274. Additionally, keys 272 also secure the piston housing 275 to the ball cartridge housing 268 by means of key slots and screws 273 affixing the keys 272 to the housing 275. A seal element 276 is carried on the piston housing 275 to prevent fluid communication between the housing 275 and an interiorly carried tubing piston 419 of the ball valve cartridge assembly 400. The seal 276 also defines the uppermost end of a chamber 422 bridging the tubing piston 419 and the piston housing 275 and communicating with a transverse passage 277 bored through the piston housing 275 for communication of casing fluid to allow the piston 419 to move upwardly during manipulation of the ball valve elements to closed position by well pressure assistance. The piston housing 275 is secured by means of threads 278 to a bottom sub element 279, a face key 280 being secured to the piston housing 275 by means of key slots and screws 281. An O-ring seal element 283 is carried at the uppermost end of the piston housing 275 to prevent fluid communication between the housing 275 and the ball cartridge housing 268. A similar O-ring element 284 is carried on the piston housing 275 below the threads 274, for the same purpose. A seal element 282 is defined within the bottom sub 279 to prevent fluid communication between the bottom sub 279 and the piston housing 275.

The central collet or outer latch assembly 300 is defined at its uppermost end by a latch safety piston 301 which is shiftable downwardly to maintain the latch housing 309 and the lock sleeve 313 into engagement on the fingers 316, relative to the groove 260A, when the ball valves are manipulated to open and closed positions, by application of pressure through one of the chambers 'B' and 'E'. A seal element 302 is carried interiorly of the latch safety piston 301 and defines the lowermost end of the chamber 'E'. A similar seal 303 is exteriorly carried around the latch safety piston 301 and defines the lowermost end of the chamber 'B'. A transverse fluid passage porthole 301A is bored through the latch safety piston 301 and communicates fluid between chamber 'B' and the passage 203 by way of port 219 (FIG. 4A). A similar seal element 304 is carried at the lowermost end of the latch safety piston 301 to prevent fluid communication between the piston 301 and the main control housing 209 interior thereof.

Below the latch safety piston 301 is a latch piston element 305 secured by threads 308 to a longitudinally extending exterior latch housing 309. The latch piston element 305 has a bored key-way 307 exterior thereon for rotational receipt of the lug 108 on the central body 107, during mechanical unlatching of the inner stinger 200. A seal element 306 is carried interiorly on the latch piston 305 to prevent fluid communication between the latch piston element 305 and the main control housing 209 of stinger 200.

The latch housing 309 is slotted at 310 and receives an exteriorly protruding key 334 therein which is operational during the mechanical unlatching of the inner stinger 200 to interengage with the latch housing 309 to urge the housing 309 and the lock sleeve 313 upwardly into unlatching position. The latch housing has a downwardly facing circumferentially extending lower contact shoulder 309' which is hit by the mechanical release sleeve 322 to interface sleeve 322 and housing 309 during the mechanical unlatching procedure. The latch housing 309 is secured at threads 311 to the lock sleeve 313, with a rectangular shaped spring retainer 312 being carried between the lock sleeve 313 and the latch housing 309 to encase the lowermost end of a series of belleville springs 320 which urge the central collet assembly 300 downwardly into latching position relative to the groove 260A.

The lock sleeve 313 has a smooth interior surface 314 which rides along the exterior surface of the fingers 316 for shifting of the fingers 316 between latching and unlatching positions relative to locking shoulders 259B and 260B. A beveled shoulder 315 on the lock sleeve 313 is contoured to companionly interface with the upper end 319 of the fingers 316 such that the fingers 316 are "rocked" upon the rocker sections 259–260 and into the unlatching groove 258, so that the fingers 316 are moved away from latching engagement relative to the groove 260A during hydraulic or mechanical unlatching. Additionally, the inner surface 314 of the lock sleeve 313 may move downwardly upon the exterior of the fingers 316 to urge the fingers 316 away from the unlatching groove 258 and upon the rocker sections 259–260, such that the fingers 316 are interengaged into the groove 260A with the lock sleeve 313 snugly engaged around the exterior of the fingers 316, so that this position prohibits movement away from the groove 260A.

The fingers 316 are profiled at 317 to companionly be received upon the beveled shoulder portion 260B of the groove 260A, with the lock shoulder 318 on the fingers 316 being received on the upper periphery of the rocker sections 259–260.

The series of belleville spring elements 320 are carried interiorly of the latch housing 309 above the spring retainer 312 and below a companion upper spring retainer 321, for urging the latch housing 309 downwardly, relative to the inner stinger 200.

A mechanical release sleeve 322 is secured by means of threads 333 to the latch lock spring housing 229, the mechanical release sleeve 322 carrying the key 334 which is housed protrudingly within the slot 310 of the latch housing 309. Upper and lower screws 341 and 340 secure the key 334 to the mechanical release sleeve 322. The sleeve 322 also is rotationally secured to the latch lock spring housing 229 by means of a shear release pin 344 interfaced on the release sleeve 322 by means of a retainer nut 343 which is secured to the sleeve 322 at threads 342. Because of the securement of the pin 344 into the housing 229, the sleeve 322 cannot rotate relative to the housing 229, until such time as the shear release pin 344 is sheared.

Figure 4B:
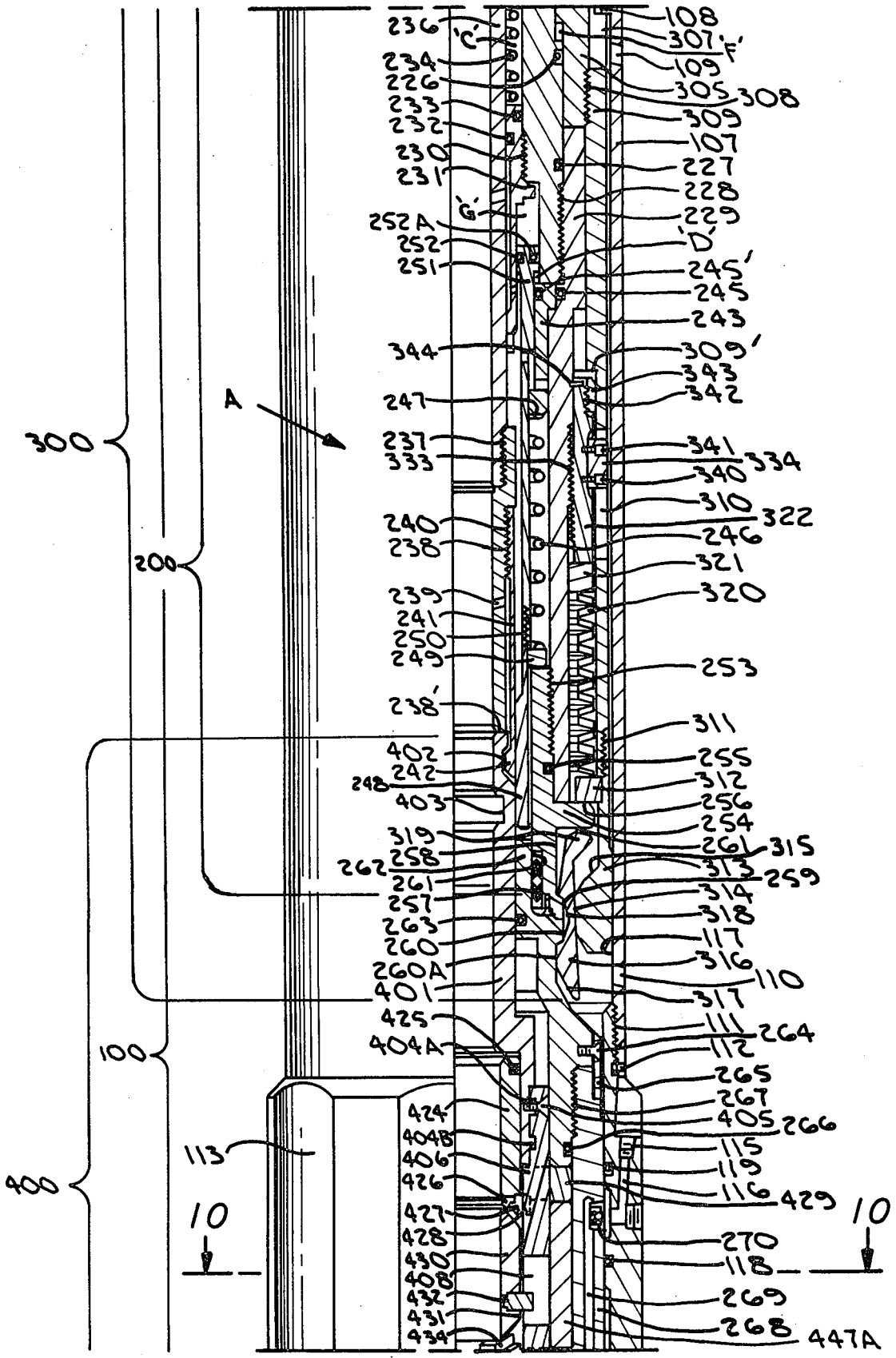
Figure 4C:
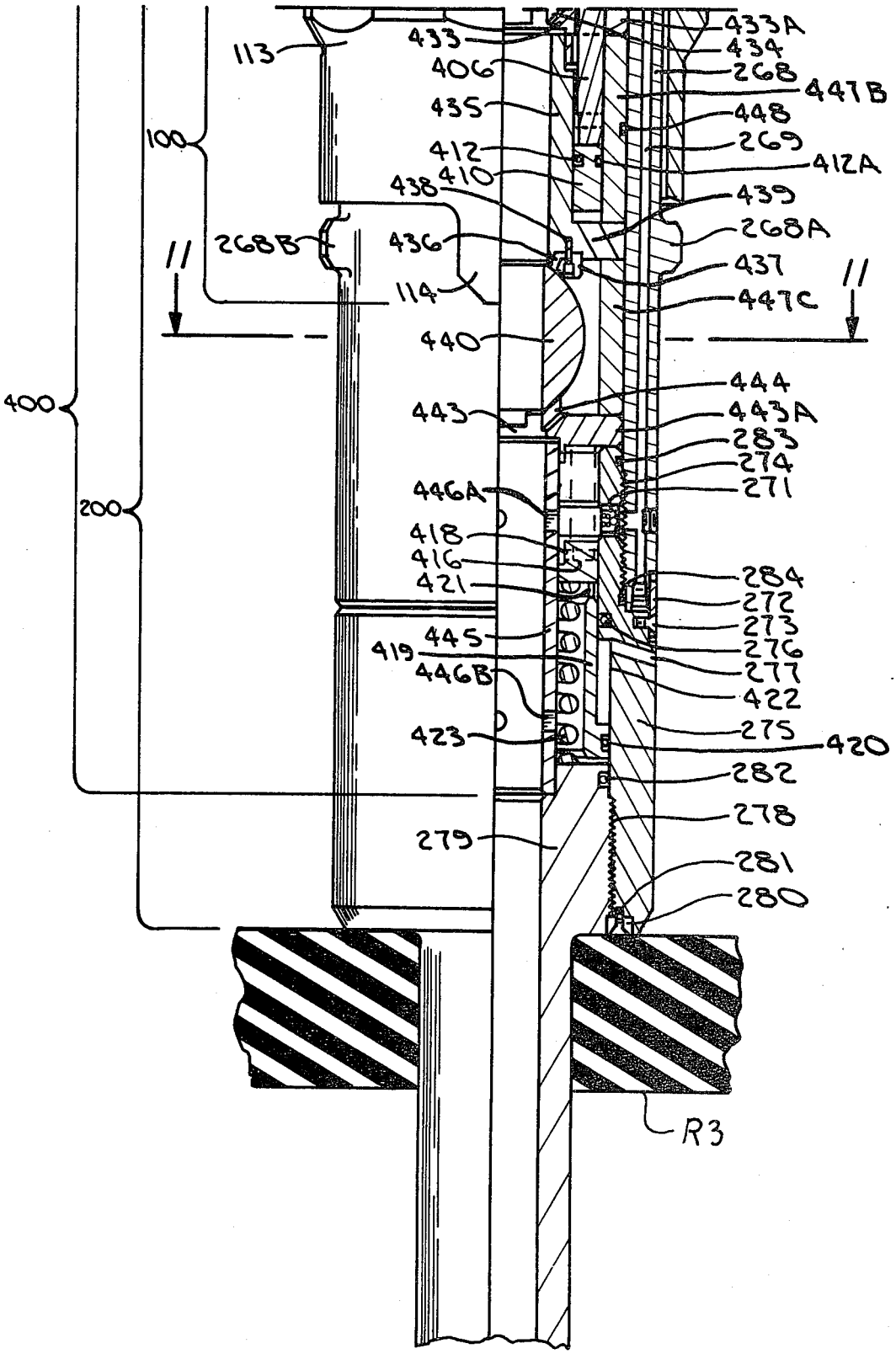

The ball valve cartridge assembly 400 is housed interiorly of the outer housing 100 and at the lowermost end of the stinger assembly 200. The latch receptacle 401 defines the uppermost end of the ball valve cartridge assembly 400, with a tapered groove 402 for receipt of the fingers 242 of the inner latch 241, and an inwardly facing plug profile 403 for selective receipt of a plug, (not shown) run by wireline, or the like, for additional sealing engagement interiorly of the apparatus A, to further assure against fluid transmission from the well W within the apparatus A. Also, latch receptacle 401 has its uppermost tip end 401' (FIG. 5B) which interfaces with the lower end 238' of the inner latch mandrel 238 to transmit downward longitudinal movement to the ball valves during the ball opening sequence. Engaging shoulders 404A and 404B are defined at the lowermost end of the latch receptacle 401 for companion receipt of engagement receptacles 407A and 407B on each of two upper ball cage segments 406, the segments 406 being spaced 180° apart from one another. The segments 406 are secured to the latch receptacle 401 by means of screws 405. The segments 406 define a cam slot 408 (FIG. 4B) therein for receipt and travel of a camway pin 432 secured to a smooth peripheral outer surface 431 of the upper ball valve element 430.

Now referring to FIGS. 12A-1 through 12F-2, 13A, 13B, 14 and 15, the upper ball valve camway slot 408 is contoured and has a comparatively short terminal section 408A' where the pin 432 is engaged at the position 408A when the upper ball element 430 is in closed position. The cam slot 408 has a sloped rotation travelway 408B communicating with the short camway portion 408A'. The top of the rotation travelway 408B communicates to a long axial camway portion 408C for receipt of the pin 432 subsequent to manipulation of the upper and lower ball valves assemblies to the open position. The long axial camway portion 408C has a terminal position at 408E (FIG. 12F-1) where the pin 432 is locked into the track 408C when the ball valves are in the open position.

The upper ball cage segments 406 have a "T" lock element 409 (FIG. 13A) at the lowermost end thereof which are slidingly and securely received within companion "T" lock grooves 411 in a cage segment adapter 410 therebelow. An elastomeric seal element 412 is carried interiorly and circumferentially around the cage segment adapter 410 to prevent fluid communication between a lower ball cage segment retainer 435 and the cage segment adapter 410. A cage segment retainer 447A is carried longitudinally and interiorly of the ball cartridge housing 268, and an elastomeric seal 412A is carried exteriorly and circumferentially around the cage segment adapter 410 to prevent fluid communication between the cage segment retainer 447A and the cage segment adapter 410.

Figure 14:
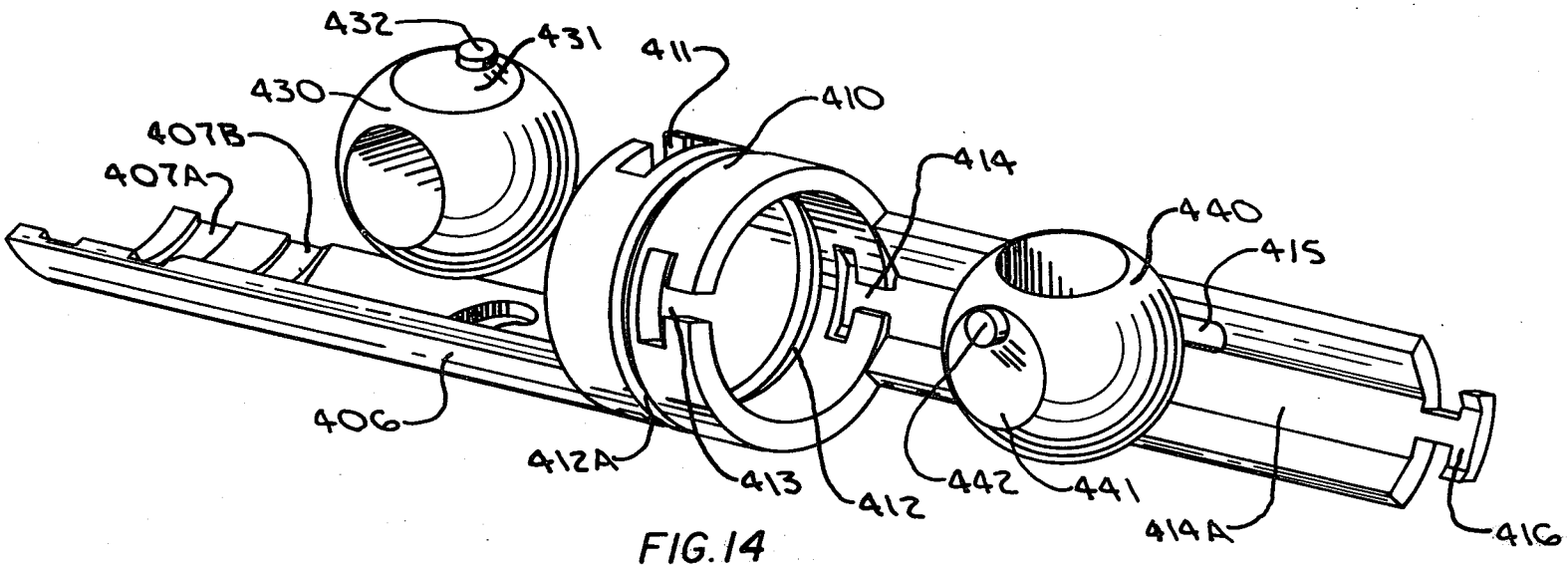
FIG. 14 is a perspective view of the upper and lower ball valve assemblies in closed position.
Figure 15:
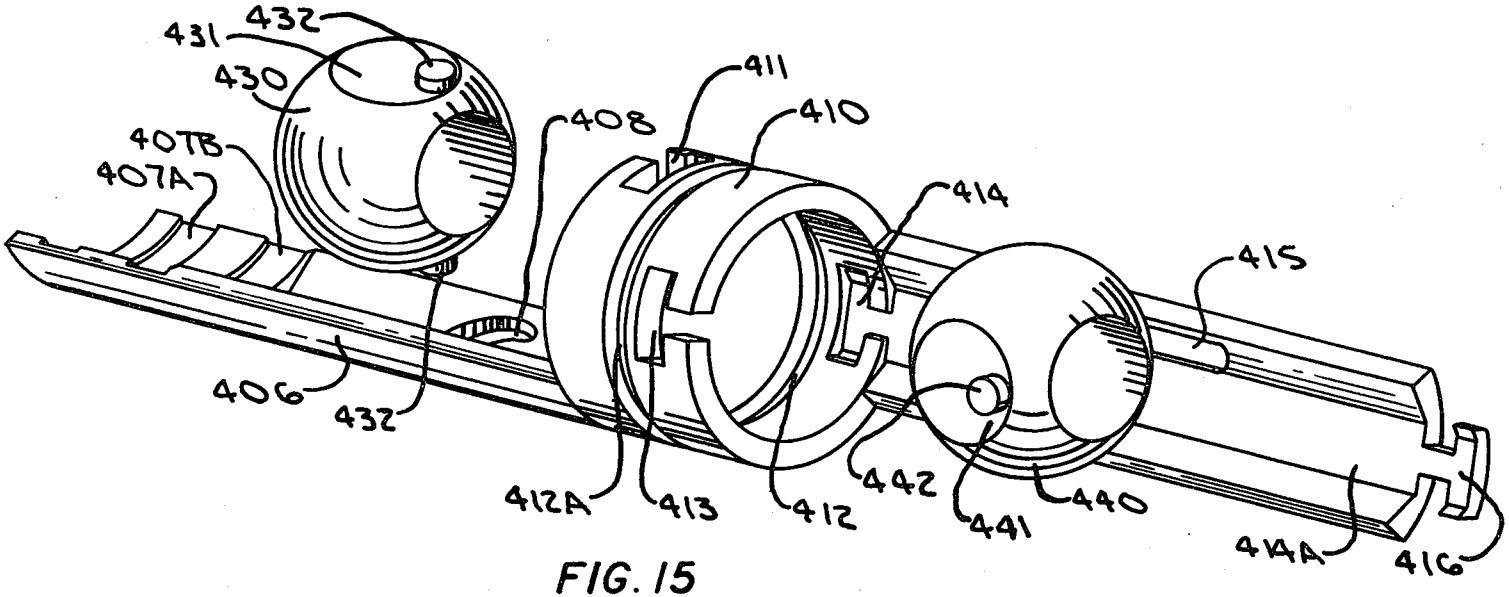
FIG. 15 is a view similar to that of FIG. 14, illustrating the ball valve assemblies rotated to open position.

Spaced 90° on the lower end of the cage segment adapter 410 are two "T" lock grooves 413, (FIG. 14) similar in construction and function as the "T" lock grooves 411. The lower "T" lock grooves 413 each receive the lower "T" locks 414 at the uppermost end of the lower ball cage segments 414A, the lower ball cage segments 414A being at a 90° angle to each of the upper ball cage segments 406, as shown in FIGS. 14 and 15.

The lower ball cage segments 414A are similar in configuration as the upper ball cage segments 406, each of the segments 414A having a lower cam slot 415 thereon for receipt and travel of camway pins 442 secured to the lower ball 440 and spaced 180° from one another on the flat outer peripheral surface 441 of the ball 440. The lower camway slot 415 has a long camway portion 415A' (FIG. 12A-2) for carriage of the pin 442 from the closed terminal 415A as the upper ball 430 is manipulated to open position. It should be noted that the length of the long camway portion 415A' of the lower camway slot 415 is extended, and is longer than the short camway portion 408A' of the upper camway slot 408, such that the pin 432 in the upper camway slot 408 moves to the bottom of the rotation travelway 408B to the open end of the long camway portion 408C prior to the pin 442 on the lower ball 440 entering into its rotation travelway 415B.

Thus, the camway slots 408–415 are configured such that the lower ball does not begin its manipulation between closed and open positions, and vice versa, prior to the upper ball 430 being completely reciprocated to one of its open or closed positions.

Figures 2, 12A:
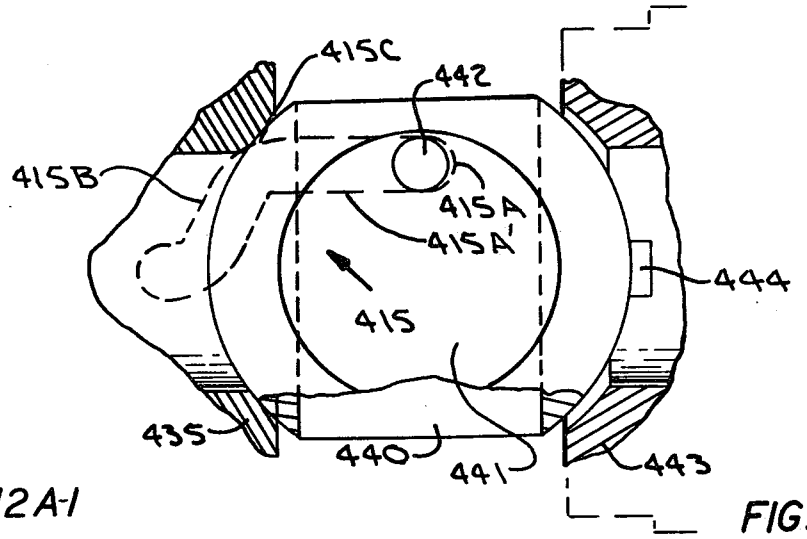
Figures 1, 12A:
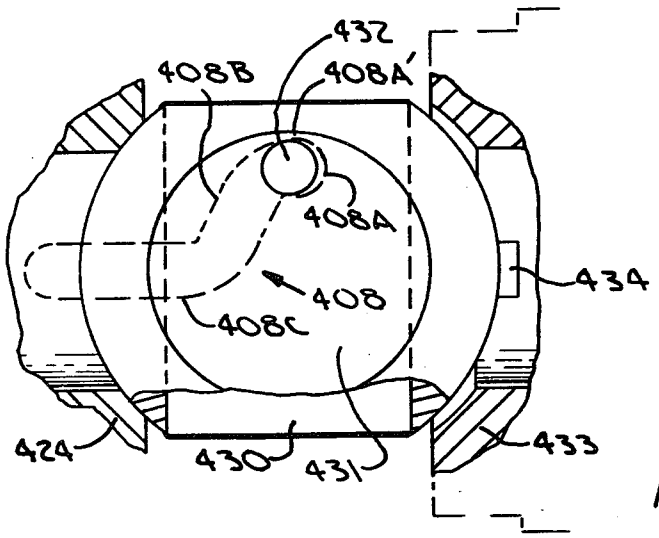
Figures 2, 12B:
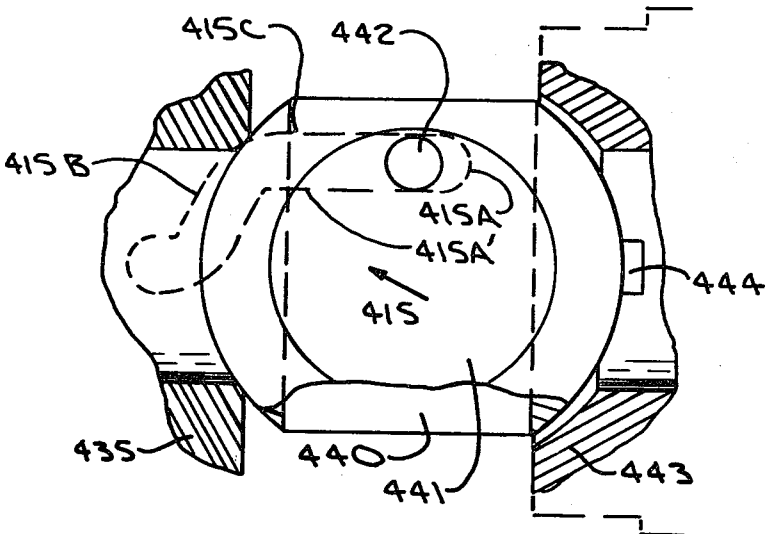
Figures 1, 12B:
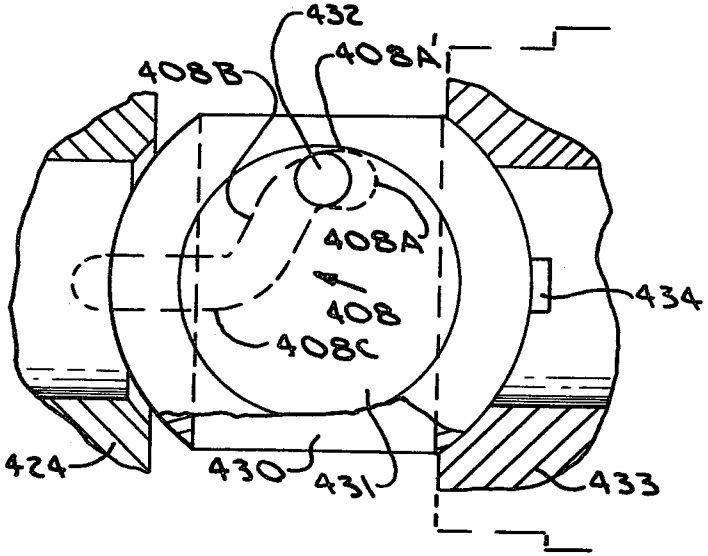
Figures 2, 12C:
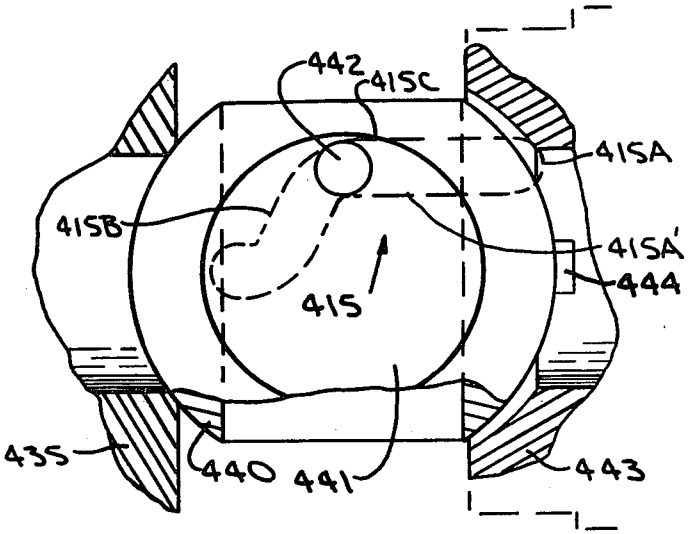
Figures 1, 12C:
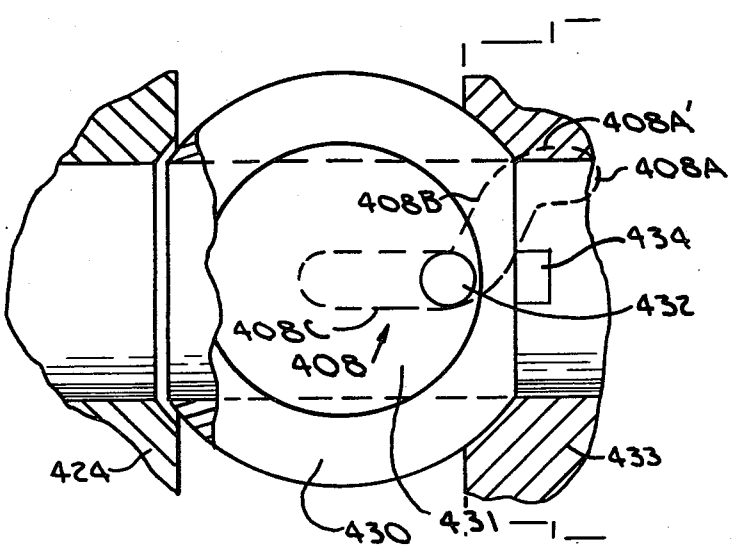
Figures 2, 12D:
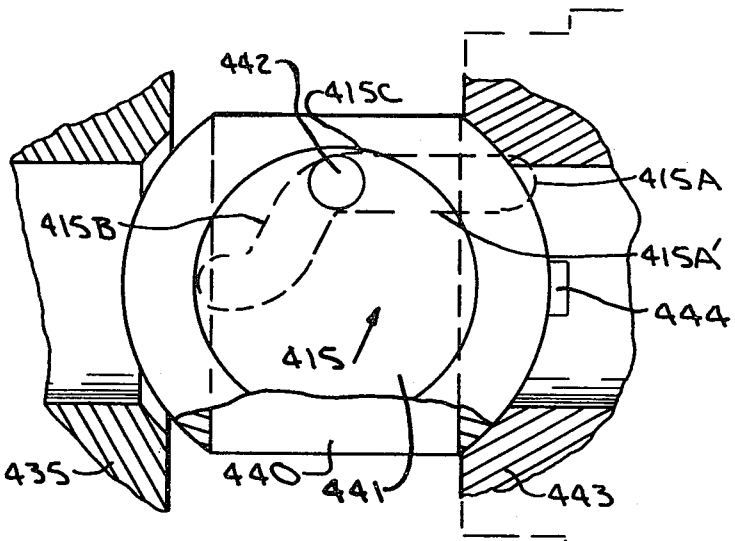
Figures 1, 12D:
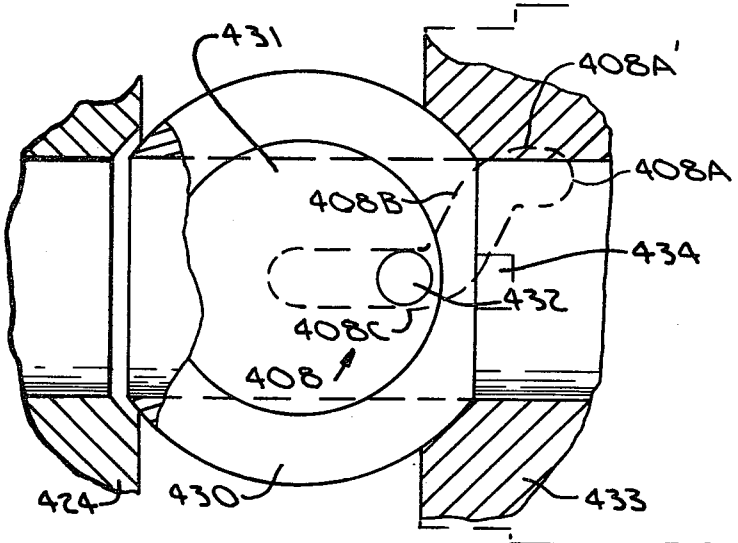
Figures 2, 12E:
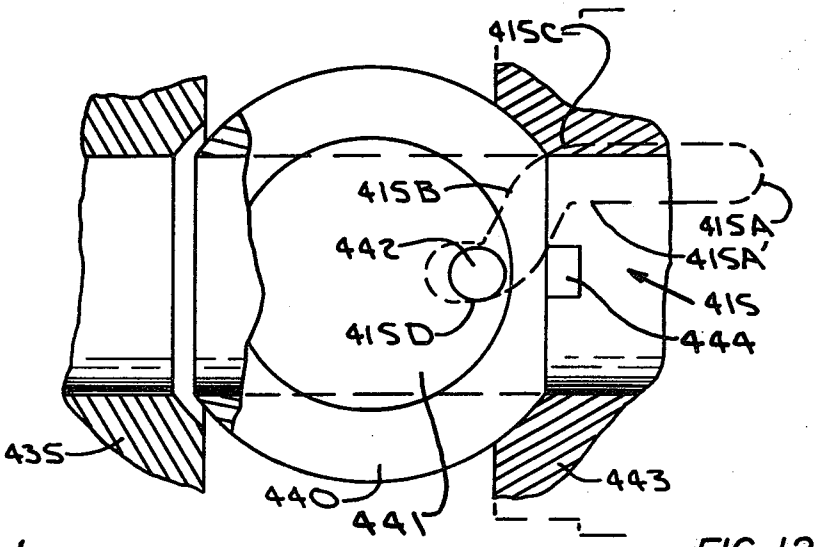
Figures 1, 12E:
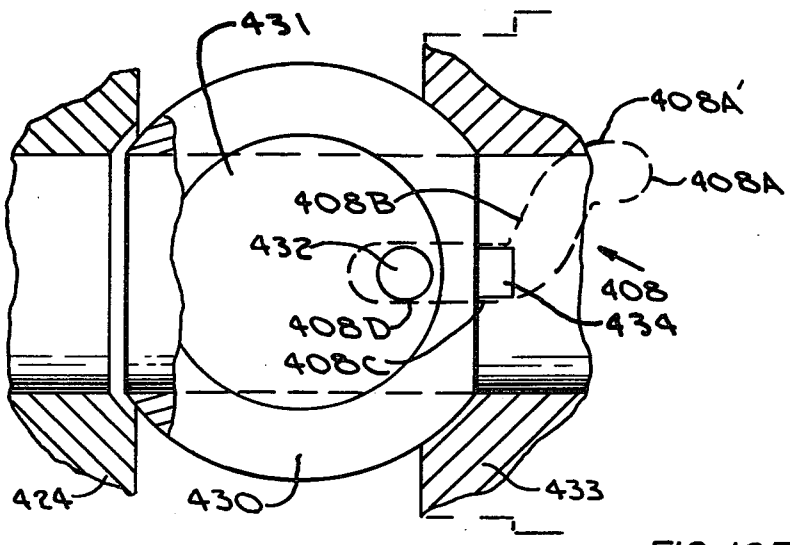
Figures 2, 12F:
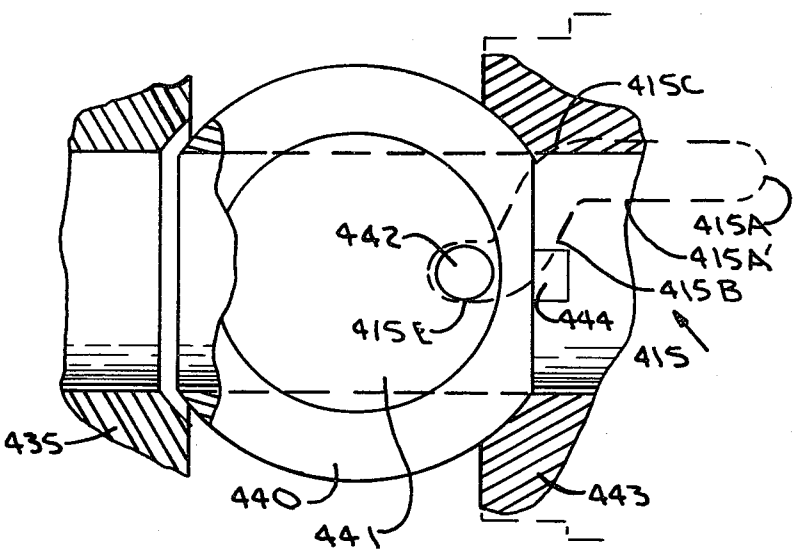
Figures 1, 12F:
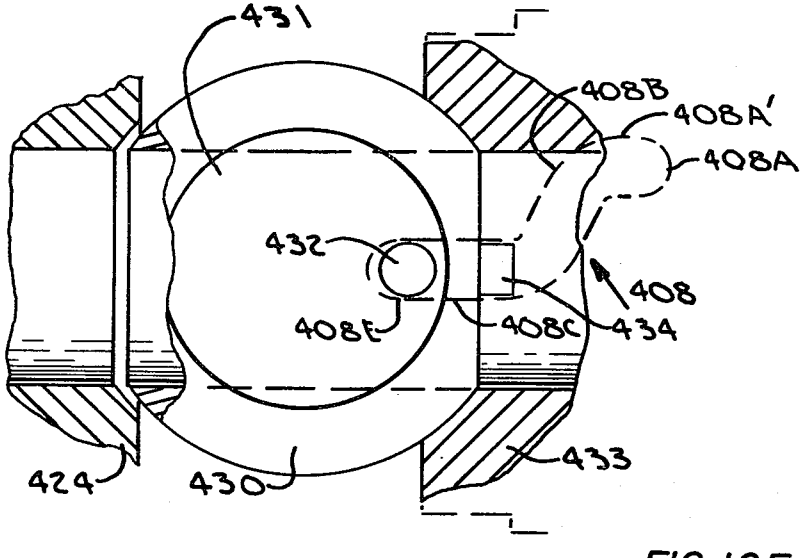
Figure 13A:
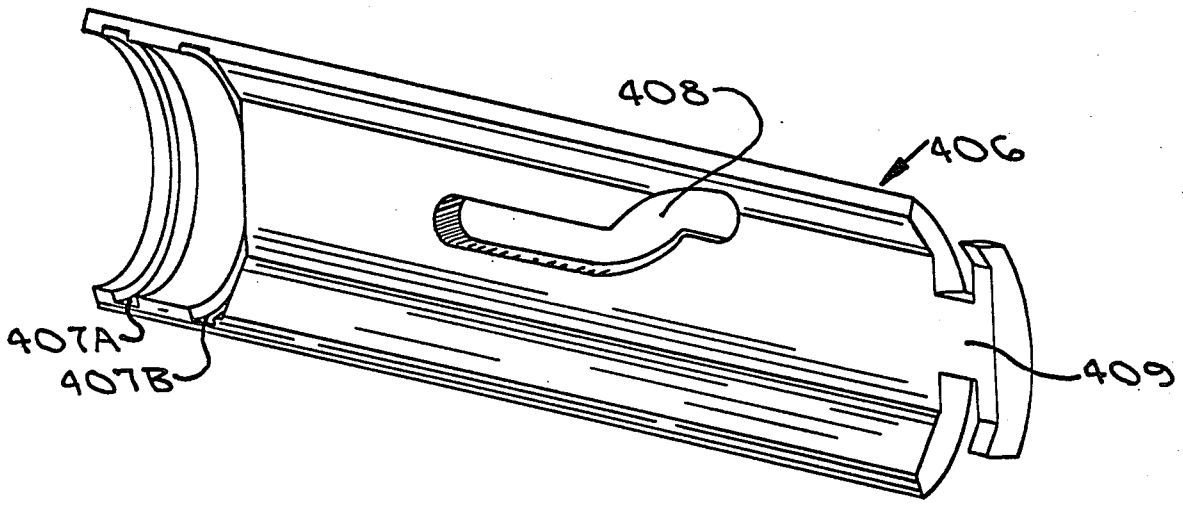
FIG. 13A is a perspective view of an upper ball cage segment and of the configuration of the upper camway slot.
Figure 13B:
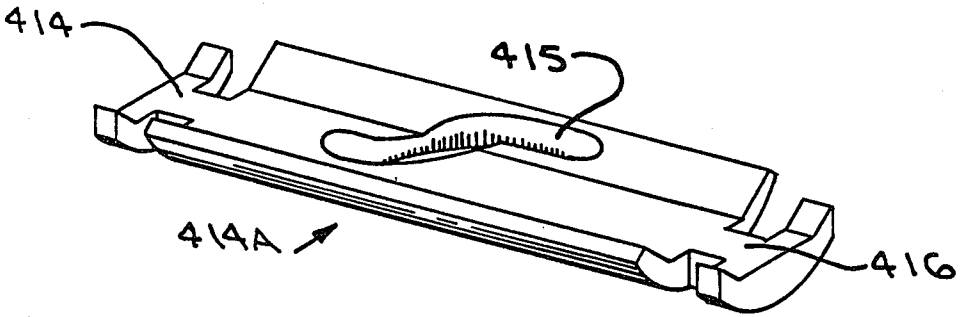
FIG. 13B is a view similar to that of FIG. 13A, illustrating in perspective a lower ball cage segment and the lower camway slot thereon.

The long camway portion 415A' of the lower camway slot 415 terminates at an open end 415C which communicates with and begins the rotation travelway 415B. The lower camway 415 is terminated at a position 415D (FIG. 12E-2) for receipt of the pin 442 when the lower ball element 440 has been completely manipulated to open position. The upper and lower ball cage segments 406 and 414A are permitted to shift longitudinally downwardly thereafter, somewhat, to lock the pins 432 and 442 in their respective tracks, the lower pin 442 being locked into the track at the position 415E (FIG. 12F-2).

The lower ball cage segments 414A have lower "T" locks 416 thereon which are snugly received within a companion "T" lock receptacle 418 on a lower cage segment stop plate 417 (FIG. 3C) housed between a spring guide 445 and the ball cartridge housing 268.

A tubing piston 419 is carried circumferentially and interiorly of the piston housing 275 and has a seal element 420 in the lowermost portion thereof exteriorly communicating with the interior of the piston housing 275. The seal 420 defines the lowermost end of a piston chamber 422, while the upper seal 276 in the piston housing 275 defines the uppermost end of the chamber 422. Since the pressure within the chamber 422 always will be lower than the pressure in the interior of the apparatus A and below the lower ball 440, the tubing piston 419 will be urged upwardly, and functions with a ball operator return spring 423 carried around the exterior of the spring guide 445, to urge the upper and lower ball cage segments 406 and 414A upwardly to rotate the ball valves 430 and 440 to their closed position.

A slotted passage 421 is cut through the uppermost end of the tubing piston 419 to communicate through the valve 271 to the passage 269 for injection of inhibitor to the interior of the apparatus A.

The ball valve cartridge assembly 400 also consists of an upper ball cage segment retainer 424 have a seal 425 at its uppermost end to prevent fluid communication between the retainer 424 and the latch receptacle 401. The retainer 424 carries at its lowermost end, a seal element 426 with a slightly protruding surface which engages the exterior of the upper ball 430 when the ball is in closed position. The seal 426 is contoured by a seal retainer 427 held in place on the upper ball cage segment retainer 424 by means of a screw 428. The upper ball cage segment retainer 424 is held in place between the latch finger lower receptacle 262 and an upper cage segment retainer member 447A by an outwardly protruding securing shoulder 429. The middle cage segment retainer member 447B contains an O-ring 448 on its exterior to prevent fluid communication between the cage segment retainer member 447B and the ball cartridge housing 268.

As shown in FIGS. 14 and 15, the pins 432 and 442 are eccentrically mounted on their respective ball elements 430–440 and are off-set relative to the rotational axis of the ball elements 430–440. Such off-set positioning of the pins 432–442, in conjunction with the configuration of the camway slots 408–415, enables the ball elements 430–440 to be rotatable between closed and open positions by longitudinal manipulation of the upper and lower ball cage segments 406–414A.

It will be appreciated that the ball valve cartridge assembly 400 may be easily inserted, removed and/or reinserted into its housing within the apparatus A when the bottom sub 279 and the piston housing 275 are not secured to the ball cartridge housing 268. The ball valve cartridge assembly 400 may be removed from within the ball cartridge housing 268 for repair or replacement of one or more components comprising the ball valve cartridge assembly 400 simply by first rotationally unthreading the bottom sub 279 from the piston housing 275 at the threads 278. Thereafter, the piston housing 275 is rotationally unthreaded from the ball cartridge housing 268 at the threads 274. Since the lower cage stop plate 417, the lower ball cage segment 414A, the segment adapter 410, the upper ball cage segment 406, and the latch receptacle 401 all are interengaged with the upper and lower ball cage segment retainers 424–435, and the upper and lower ball retainers 433–443, and thereby interengaged with the cage segment retainer members 447A, 447B and 447C, the entire ball valve cartridge assembly 400 may be easily removed from the ball cartridge housing 268 simply by applying a pushing force through a mandrel or the like upon the latch receptable 401, either before or after removal of the ball operator return spring 423 and a spring guide 445.

A ball retainer element 433 encapsulates the upper ball 430 at its lowermost end and is maintained in position with the upper cage segment retainer 447A through a securing shoulder 433A, a passage 434 being defined through the retainer 433 to permit pumping of mud or other well killing fluids across the upper ball 430, while the ball is closed, if this procedure is desirable.

The upper ball retainer 433 also is secured in place to a lower ball cage segment retainer 435 which, in turn, carries a seal element 436 which has its lower periphery sealingly engagable upon the smooth outer surface of the lower ball element 440. The seal element 436 is held in place by means of a seal retainer 437 which is secured to the lower ball cage segment retainer 435 by screws 438.

The lower ball cage segment retainer 435 is held in place onto the middle cage segment retainer 447B by an outwardly extending securing shoulder 439 and locked into position by the lower cage segment retainer member 447C. A lower ball retainer 443 rests upon the lower periphery of the lower ball 440 and also has defined therearound a fluid passage for continuation of mud fluid flow, or the like, during killing of the well while the upper and lower ball elements 430 and 440 are maintained in closed position. The lower ball retainer 443 is held in place relative to the lower cage segment retainer member 447C by an outwardly extending securing shoulder 443A, and the uppermost end of the piston housing 275.

Below the lower ball retainer 443 is a cylindrical spring guide 445 having ports 446A and 446B bored therethrough to permit transmission of inhibitor from the passage 269 into the interior of the apparatus A, and also to permit well pressure therebelow to act upon the seal 420 and the piston 419.

OPERATION

It will be appreciated that the apparatus A is run within the riser R on the tubing string T with the upper and lower ball elements 430 and 440 in the fully open position. The pipe rams R-3 are snugly and sealingly engaged upon the bottom sub 279 to hold the apparatus A in position. This position is as shown in FIG. 1.

Figure 2A:
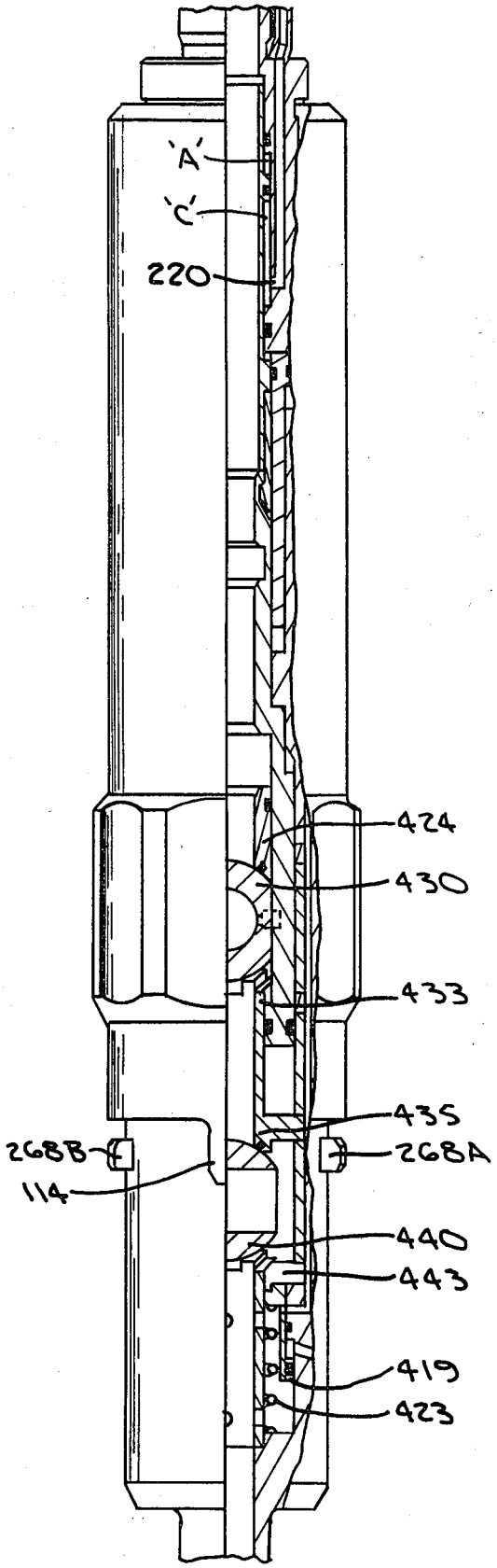
FIG. 2A is a longitudinally extending, somewhat schematic illustration of the apparatus in latched position with the ball valves manipulated to closed position.
Figure 2B:
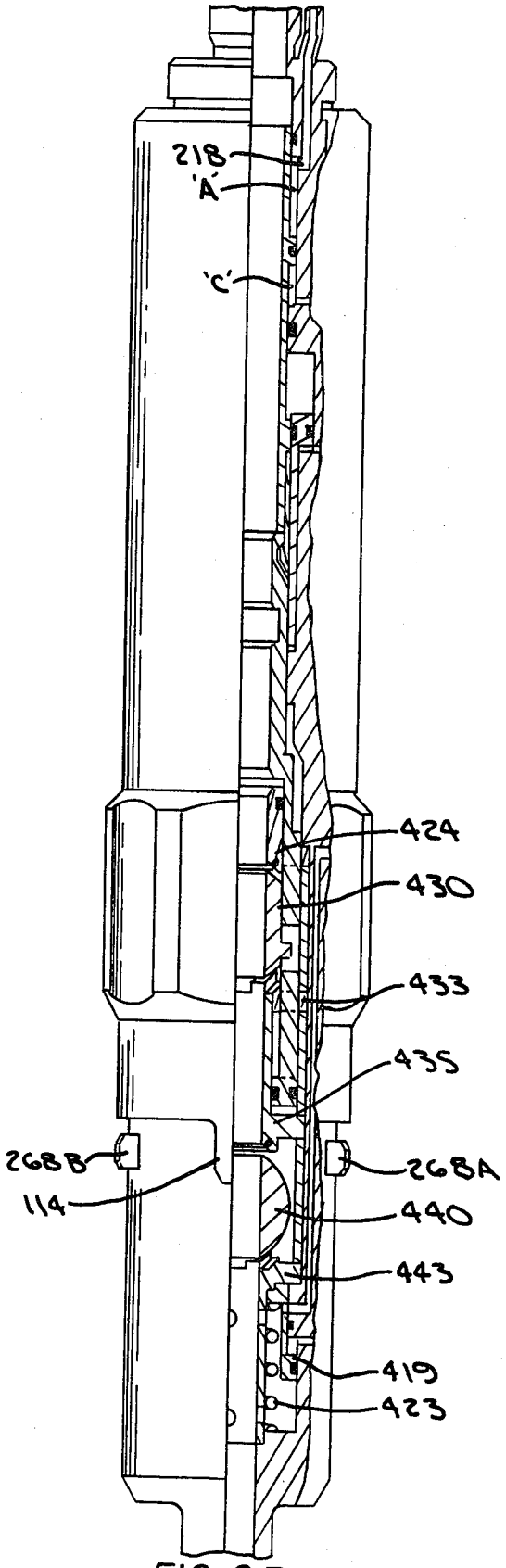
FIG. 2B is a view similar to that of FIG. 2A, showing the position of the component parts of the apparatus with the ball valves in open position.

Now referring to FIGS. 2A, 3A, 3B and 3C, when it is desired to manipulate the ball valve elements 430 and 440 of the apparatus A to the open position to, for example, insert wireline test tools therethrough and into the well W, the ball elements 430 and 440 are manipulated to the open position, as shown in FIGS. 2B. 4A, 4B, 4C and 15 by applying hydraulic pressure from the control panel CP through the control line and passage 203 through the port 218 and into the chamber 'A'. This pressure acts within the chamber 'A' and across the seal 235 to urge the ball operator piston 236, which is in engagement with the actuator receptacle 401, longitudinally downwardly, together with the upper and lower ball cage segments 406 and 414A to open the ball valve elements. The inner latch retainer 248 maintains inner latch fingers 242 in engagement with the groove 402 in actuator receptacle 401.

Now referring to FIGS. 12A-1 through 12F-2, and FIGS. 13A and 13B, as pressure is applied through the passage 203 to shift the upper and lower ball cage segments 406 and 414A downwardly, the "closed" terminal position 408A for the pin 432 moves away from the pin 432, slightly, such that the contoured edge of the rotation travelway 408B engages the pin 432 and shifts the ball element 430 downwardly away from sealing engagement with the seal 426 and onto the ball retainer 433 therebelow, to permit pressure equalization across the upper ball element 430 prior to initiation of rotation manipulation.

It should be noted that shifting of the cam slot 408 has not caused the pin 442 on the lower ball element 440 to come in contact with the rotation travelway 415B of the lower cam slot 415. Therefore, the initial closed and sealed position of the lower ball 440 has not been affected. This position is as shown in FIG. 12B-2.

As pressure is increased within the control line and passage 203, the upper and lower cage segments 406 and 414A continue downward travel and the pin 432 is contacted by the contoured rotation travelway 408B, transferring downward longitudinal movement into rotational movement across the pin 432 to rotate the ball element 430 to the completely open position. Now, the pin 432 is at the open end of the long camway portion 408C. The lower ball element 440 still has not been shifted away from its seal 436, and is in initial closed position, but the pin 442 on the lower ball element 440 has traveled to the open end 415C of the long camway portion. The position of the balls 430–440 and the camways 408–415 relative to the pins 432–442 is as shown in FIGS. 12C-1 and 12C2.

Continued application of pressure through the control line and passage 203 will cause continued longitudinal travel of the upper and lower ball cage segments 406–414A, such that the contoured rotation travelway 415B portion of the lower camway slot 415 engages the pin 442, slightly, to shift the ball element 440 downwardly, such that it is now sealingly disengaged away from its seal 436, and on to the lower ball retainer 443, to permit pressure equalization across the lower ball 440 prior to manipulation of the ball 440 from the closed to the open position. During this motion, the pin 432 of the upper ball element 430 has traveled within its long camway portion 408C, but the fully open position of the upper ball 430 has not been disturbed. This position of each of the balls 430 and 440 is as shown in FIGS. 12D-1 and 12D-2.

The lower ball element 440 is manipulated from closed to completely open position by continued application of pressure within the control line and passage 203 to further shift the upper and lower ball cage segments 406–414A longitudinally downwardly such that the contoured rotation travelway 415B engages the pin 442 and thus transfers longitudinal movement into relative rotational movement to rotate the ball element 440 from the closed position to the completely open position. Now, the pin 442 and the camway slot 415 are at the position 415D (FIG. 12E-2). It should be noted that, at this position, the fully open position of the upper ball element 430 has not been disturbed, since the pin 432 has been permitted to travel within the long camway portion 408C to the position 408D. These positions are as shown in FIGS. 12E-1 and 12E-2.

To assure that the pins 432–442 are "locked" within their respective camway portions, additional increase of pressure within the control line and passage 203 will shift the upper and lower ball cage segments 406–414A further downwardly, slightly, until the pins 432–442 are received within their respective camways at the positions 408E–415E as shown in FIGS. 12F-1 and 12F-2. Now, wireline or other tools may be inserted through the apparatus A.

It should be noted that as fluid and pressure are applied through the control line and passage 203 to act on the seal 235 and within the chamber 'A', fluid and pressure are also transmitted through the line and passage 203 to the chamber 'B' on the outer latch safety piston 301 to act on the seal 303, thus urging the safety piston 301, the outer latch piston 305, the latch housing 309 and the outer lock sleeve 313 downwardly, to assure that unlatching of the outer latch is not effected during manipulation of the ball elements 430 and 440. The position of the component parts of the apparatus A now are as shown in FIGS. 2B, 4A, 4B and 4C.

After retrieval of wireline or other tools through the apparatus A, it will be desirable to shift the ball elements 430–440 to their closed positions. This is effected by applying pressure from the control panel CP through the control line and passage 204 to the chamber 'C' below the seal 235 to urge the ball operator piston and its interrelated parts upwardly. Now, the sequence of operation described above, during the opening of the valves 430–440, is reversed, and the relative position of the camways 408–415 to the pins 432–442 is sequentially from that shown in FIGS. 12F-1 and -2, to FIGS. 12E-1 and -2, to FIGS. 12D-1 and -2, to FIGS. 12C-1 and -2, to FIGS. 12B-1 and -2, and, finally, to the original and initial position shown in FIGS. 12A-1 and -2. Now, the ball elements 430 and 440 are in the completely closed position and upon their respective seals 426–436. The upper longitudinal travel of the upper and lower ball cage segments 406–414A, such travel being permitted by application of pressure to chamber 'C' through the passage 204, is assisted by expansion of the ball operator return spring 423 urging the lower case segment stop plate 417 and the upper and lower ball cage segments 406–414A upwardly. Additionally, the ball operator return spring 423 is assisted by the pressure differential defined across the seals 420 and 276 and within the chamber 422, such that the tubing piston 419 itself is also urged upwardly against the lower cage segment stop plate 417, to further assist in longitudinal upward shifting of the cage segments 406–414A. The apparatus A now is again in position as shown in FIGS. 2A, 3A, 3B and 3C.

It should be noted that when pressure is applied within the control line and passage 204 to manipulate the ball elements 430 and 440 to closed position, pressure is also transmitted within chambers 'D' and 'E'. Pressure is applied within the chamber 'D' through the port 221 communicating to the line and passage 204 and below the seal 252A on the inner latch piston 251 to urge the latch piston 251 toward its uppermost position, such that the spring retainer 248 is snugly against the latch fingers 242 to prevent the fingers 242 from expanding out of locked engagement in the groove 402.

Pressure is also applied through the control line and passage 204 during manipulation of the ball elements 430 and 440 to the closed position, to the chamber 'E' through the port 222, and above the seal element 302 on the outer latch safety piston 301 to urge the safety piston 301 downwardly and, in turn, the outer latch piston 305, the latch housing 309 threadedly secured thereto, and the lock sleeve 313 affixed to the lowermost end of the latch housing 309. Now, the inner surface 314 of the lock sleeve 313 is held snugly against the fingers 316 to urge and maintain them into the groove 260A above the lower rocker section 260, so that inadvertent unlatching of the inner stinger 200 from the other component parts of the apparatus A cannot be effected.

In the event of the necessary removal of the drill ship DS from location or of seal or mechanical damage to the component parts of the outer housing 100, the central collet or outer latch assembly 300 and/or the component parts of the inner stinger 200 above the latch finger lower receptacle 262, may be unlatched from the ball valve cartridge assembly 400, the bottom sub 279, and interengaged parts therewith, for retrieval to the drill ship DS.

Unlatching may be effected hydraulically by application of control pressure from the control panel CP through the control line and passage 205 through the port 223 to the chamber 'F' above the seal 226 on the main control housing 209. Now, the outer latch piston 305, the latch housing 309 and the lock sleeve 313 are shifted upwardly and the beveled shoulder 315 of the lock sleeve 313 contacts and engages the contoured and beveled exterior surface of the upper end 319 of the fingers 316. The fingers 316 are now urged into the unlatching groove 258 of the latch finger upper receptacle 254, and the profile 317 of the fingers 316 is disengaged from within the groove 260A of the latch finger lower receptacle 262 and can move over the lower rocker section 260.

As pressure is applied within the chamber 'F' pressure also is transmitted to the chamber 'G' above the seals 252 and 252A on the latch piston 251 through the port 224 which communicates to the control line and passage 205. Now, the latch piston 251 and the spring retainer 248 affixed to the lowermost end thereof are urged downwardly and away from the fingers 242, such that the fingers 242 are permitted to expand exteriorly of the groove 402 on the latch receptacle 401. Now, the tubing T may be picked up for removal of the stinger 200, including the central collet or outer latch assembly 300, and the outer housing 100. This position is as shown in FIGS. 5A and 5B.

It should be noted that when the outer housing 100, the inner stinger 200 and the central collet or outer latch assembly 300 are retrieved and unlatched from the other component parts of the apparatus A, the ball operator return spring 423, together with the tubing piston 419 will urge the upper and lower ball cage segments 406–414A upwardly, thus preventing inadvertent movement of the ball elements 430–440 away from sealing engagement with their respective seals 426–436, and will also maintain the ball elements 430–440 in the completely closed position. Thus, well fluids below the lower ball 440 are not permitted to pass upwardly below the lower ball 440.

After relocation of the drill ship DS or after seal or other damage has been repaired, the outer housing 100, the inner stinger 200 and the central collet or outer latch assembly 300 may be run within the riser R on the tubing T to be relatched relative to the latch finger lower receptacle 262. This may be effected by lowering these component parts in the riser R until the profile 317 of the fingers 316 is adjacent to the groove 260A. Pressure, which has been applied through the control line and passage 205 now is lowered and withdrawn through the control panel CP. Now, since pressure is reduced within the chamber 'F', the belleville springs 320 of the central collet assembly 300 may act to shift the outer latch piston 305, the latch housing 309 moves downwardly along the exterior surface of the fingers 316, urging the profiles 317 onto into the groove 260A, with the lock shoulder 318 of the fingers 316 coming down upon the lower rocker section 260 of the latch finger lower receptacle 262.

It should be noted that since the control line and passage 205 also communicates through the port 224 to the chamber "G", pressure is exhausted from the chamber "G". With reconnection of the central collet assembly 300, the latch finger 242 will again be in position in the profiled groove 402 on the latch receptacle 401. Such interengagement between the spring retainer 248, the fingers 242 and the groove 402 will be effected when the ball elements 430–440 are manipulated to open position by pressure being exerted within the chamber "D" on the seal 252 of the latch piston 251 to overcome the force defined through the latch return spring 246 to shift the latch piston 251 and the spring retainer 248 upwardly.

After the relatching procedured, as described above, has been effected, the ball elements 430–440 may be retained in closed positioned, or may be manipulated to open position, in the manner as described above.

In the event that control pressure is lost through the control line and passage 205 for any reason, thus preventing hydraulic unlatching, as described above, the outer housing 100, the inner stinger 200 and the central collet or outer latch assembly 300 may be mechanically unlatched from the other components of the apparatus A by rotating the tubing T to the right. Sufficient pressure is first exerted to the pipe rams R-3 to insure that the lower part of the tubing string T below the apparatus A will not rotate when torque is applied to the tubing string T from the drill ship DS. Since the ball cartridge housing 268 and the outer and the lock sleeve 313 downwardly such that the inner surface 314 of the lock sleeve 313 moves downwardly along the exterior surface of the fingers 316, urging the profiles 317 into the groove 260A, with the lock shoulder 318 of the fingers 316 coming down upon the lower rocker section 260 of the latch finger lower receptacle 262.

It should be noted that since the control line and passage 205 also communicates through the port 224 to the chamber 'G', pressure is exhausted from the chamber 'G'. With reconnection of the central collet or outer latch assembly 300, the inner latch fingers 242 will again be in position in the profiled groove 402 on the latch receptacle 401. Such interengagement between the spring retainer 248, the fingers 242 and the groove 402 will be effected when the ball elements 430–440 are manipulated to open position by pressure being exerted within the chamber 'D' on the seal 252 of the latch piston 251 to overcome the force defined through the latch return spring 246 to shift the latch piston 251 and the spring retainer 248 upwardly.

After the relatching procedure, as described above, has been effected, the ball elements 430–440 may be retained in closed positioned, or may be manipulated to open position, in the manner as described above.

Figure 6A:
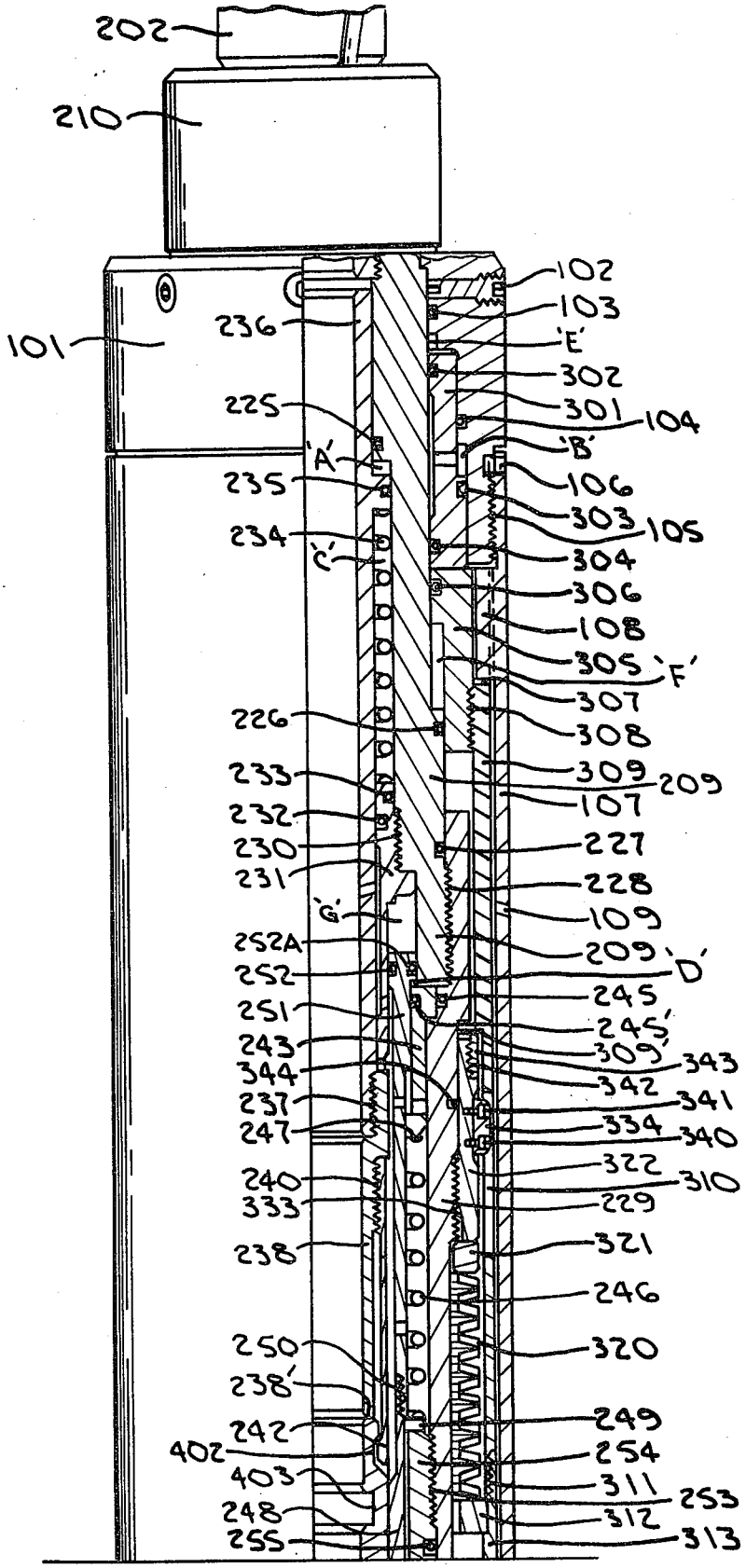
FIG. 6A is an enlarged longitudinal sectional view of the apparatus somewhat above the ball valve assemblies illustrating the apparatus during the mechanical unlatching procedure with the torque pin sheared and the lug of the outer housing being received within the keyway of the central collet assembly to prevent rotation between the central collet assembly and the outer housing. The shear release pin is released from the latch lock spring housing and the mechanical release sleeve is in its completely "walked up" position to interface with the latch housing and longitudinally shift the lock sleeve upwardly to disengage the fingers.
Figure 6B:
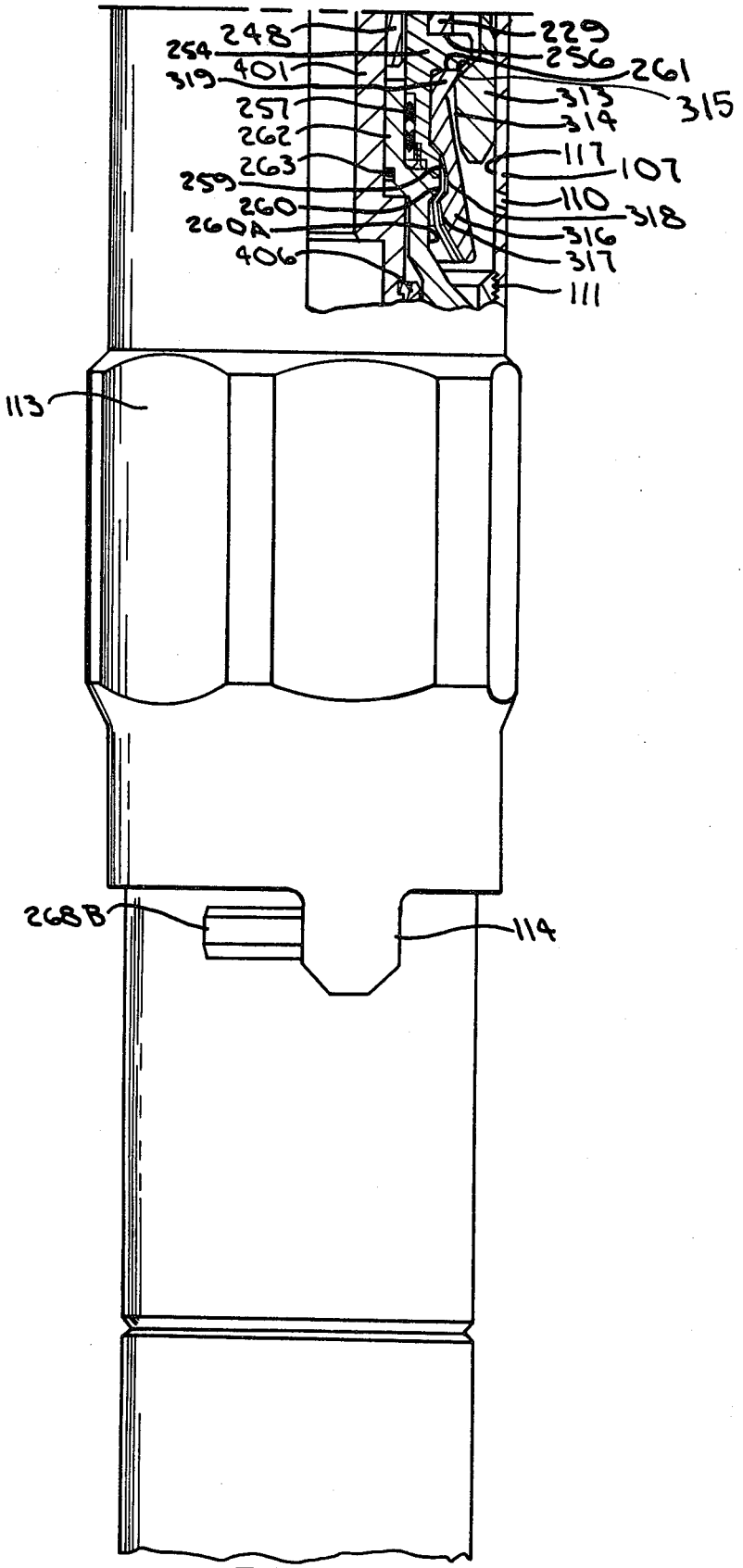
FIG. 6B is a partial elongated illustration of the apparatus during mechanical unlatching, illustrating the outer housing rotationally aligned with the lugs of the inner stinger, as provided during the initial stage of the mechanical unlatching procedure, the uppermost portion of FIG. 6B illustrating the latch in unlatched position for retrieval of the upper tubular conduit section of the drill ship.
Figure 9:
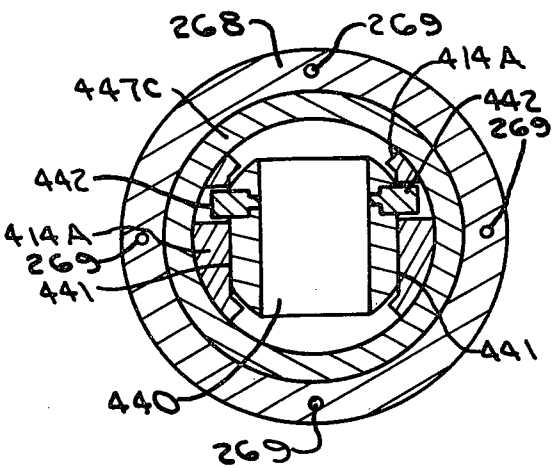
FIG. 9 is a cross-sectional view taken along line 9—9 of FIG. 3C.
Figure 8:
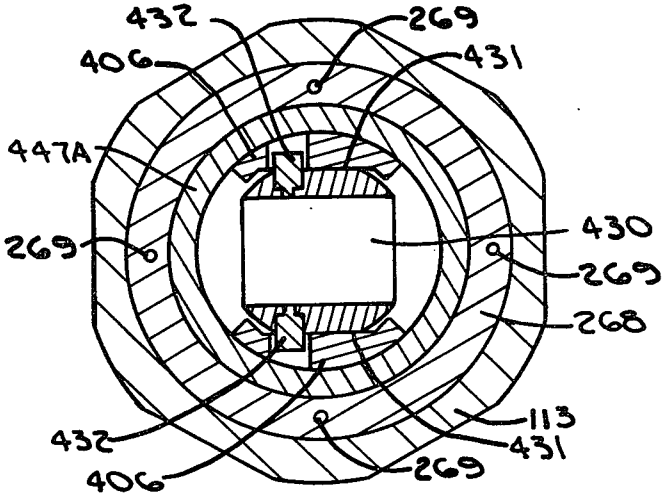
FIG. 8 is a cross-sectional view taken along line 8—8 of FIG. 3B

In the event that control pressure is lost through the control line and passage 205 for any reason, thus preventing hydraulic unlatching, as described above, the outer housing 100, the inner stinger 200 and the central collet or outer latch assembly 300 may be mechanically unlatched from the other components of the apparatus A by rotating the tubing T to the right. Sufficient pressure is first applied to the pipe rams R-3 to insure that the lower part of the tubing string T below the apparatus A will not rotate when torque is applied to the upper part of tubing string T from the drill ship DS. Since the ball cartridge housing 268 and the outer housing 100 are not rotationally engaged, such right-hand rotation will move the stop extensions 114 on the lower torque sub 113 to the outwardly protruding lugs 268A–268B on the ball cartridge housing 268, as shown in FIG. 6B. The interface of the stop extensions 114 and the lugs 268A–268B will prevent further right-hand rotation of the outer housing 100. However, since the outer housing 100 is affixed to the inner stinger 200 through the torque pin 102, continued right-hand rotation of the tubing string T will cause the shear strength of the torque pin 102 to be overcome, thus shearing the pin 102.

Now, continued right-hand rotation of the tubing string T is transmitted through the upper stinger body 202, to the main control housing 209, to latch lock spring housing 229 and latch finger upper receptacle 254, and because the belleville springs 320 urge the latch housing 309 and the lock sleeve 313 downwardly, the spring retainer 312 is secured against the shoulder 256 of the latch finger upper receptacle 254, so that the inner stinger 200 will rotate a slight distance to the right with the central collet assembly 300 until the lug 108 in the key-way 307 engages the outer latch piston 305. This position is shown in FIG. 6A. Since the outer housing 100 is secured between the stop extensions 114 and the lugs 268A–268B, thus preventing rotation of the outer housing relative to the central collet assembly 300, such interface between the lug 108 and the latch piston 305 together with continued right-hand rotation of the tubing string T will cause the key 334 on the mechanical release sleeve 322 to rotate within the slot 310 until further rotational of the tubing string T, the stinger body 202, the main control housing 209 and the latch lock spring housing 229 is prevented when the key 334 interfaces with the latch housing 309. Now, the torque will be transmitted from the tubing string T through the latch lock spring housing 229 to the mechanical release sleeve 322, until such time as the shear strength of the shear release pin 344 is overcome. The shear release pin 344 will shear, thus permitting continued right-hand rotation of the tubing string T to be transmitted into longitudinal upward movement of the mechanical release sleeve 322, and the sleeve 322 will move upwardly relative to the latch lock spring housing 229 through threads 333 until the mechanical release sleeve 322 engages the latch housing 309 at the shoulder 309', thus shifting the latch housing 309 upwardly. This position is as shown in FIG. 6A.

As continued right-hand rotation of the tubing string T is effected, the latch housing 309 will shift upwardly carrying the lock sleeve 313 and moving the beveled shoulder 315 of the sleeve 313 toward the upper end 319 of the fingers 316, until the upper end 319 is interfaced on the unlatching groove 258 of the latch finger receptacle 254. Now, the profiles 317 of the fingers 316 are moved away from locking engagement in the groove 260A and are moved above the lower rocker section 260. Since the latch sleeve return spring 246 always urges the spring retainer 248 and the latch piston 251 downwardly to the position shown in FIG. 6A, the fingers 242 on the latch 241 may be freely moved outwardly from within the groove 402 when the tubing string T is pulled. Mechanical unlatching of both the inner and outer latches now has been effected. This position is the same as shown in FIG. 5B.

The outer housing 100, the inner stinger 200 and the central collet assembly 300 may be mechanically relatched on to the other components of the apparatus A be reinserting them into the riser R on the tubing T and locating the fingers 316 adjacent the groove 260A. Now, the tubing T is rotated to the left and the mechanical release sleeve 322 will "walk" down by means of the threads 333 and separate from interface with the shoulder 309' on the latch housing 309. After this position, further left-hand rotation will become increasingly more difficult until it ceases when the spring retainer 312 stops against the shoulder 256 of the latch finger upper receptacle 254. Now, the inner surface 314 of the outer lock sleeve 313 has been caused to travel downwardly along the exterior surface of the fingers 316 until the profile 317 of the fingers 316 are secured within the groove 260A above the lower rocker section 260. The lock shoulder 318 of the fingers 316 now will become snugly and securely rested upon the lower rocker section 260. With the profiles 317 of the fingers 316 snugly engaged within the groove 260A, and the lower rocker section 260 receiving the lock shoulder 318, the apparatus A is in its fully relatched position, and the ball elements 430–440 may be reciprocated to open position, if desirable.

In summary therefore, the latching apparatus embodying this invention incorporates both an inner latch and an outer latch. Such latches may be concurrently moved to an unlatched position through the application of fluid pressure to pistons connected to the latching mechanisms. Such fluid pressure induced movements of the two latching mechanisms does not, however, effect the retention of the two ball valves in their closed positions. When the ball valves are shifted to their opened position, through the application of fluid pressure, fluid pressure is concurrently applied to both the inner and outer latch mechanisms to maintain them in their latched positions, thus assuring against separation of the apparatus at any time that the ball valves are in their open position.

In the event of a failure in control pressure, the ball valves are returned to their closed positions by the spring mechanisms which were compressed when the valves were moved to their opened positions by the application of fluid pressure, and the spring mechanisms are assisted by well pressure. Both the inner and outer latch mechanisms may then be mechanically shifted to an unlatched position by applying a right-hand rotation to the apparatus through the connected tubing string above the apparatus, while maintaining the lower portion of the apparatus clamped against rotation by a pipe ram engaging the portion of the tubing string below the apparatus. The reconnection of the severable parts of the apparatus may be conveniently accomplished, irrespective of whether the initial separation was achieved by fluid pressure actuation or by mechanical actuation of the inner and outer latch mechanisms.

ALTERNATE EMBODIMENT

Figure 16A:
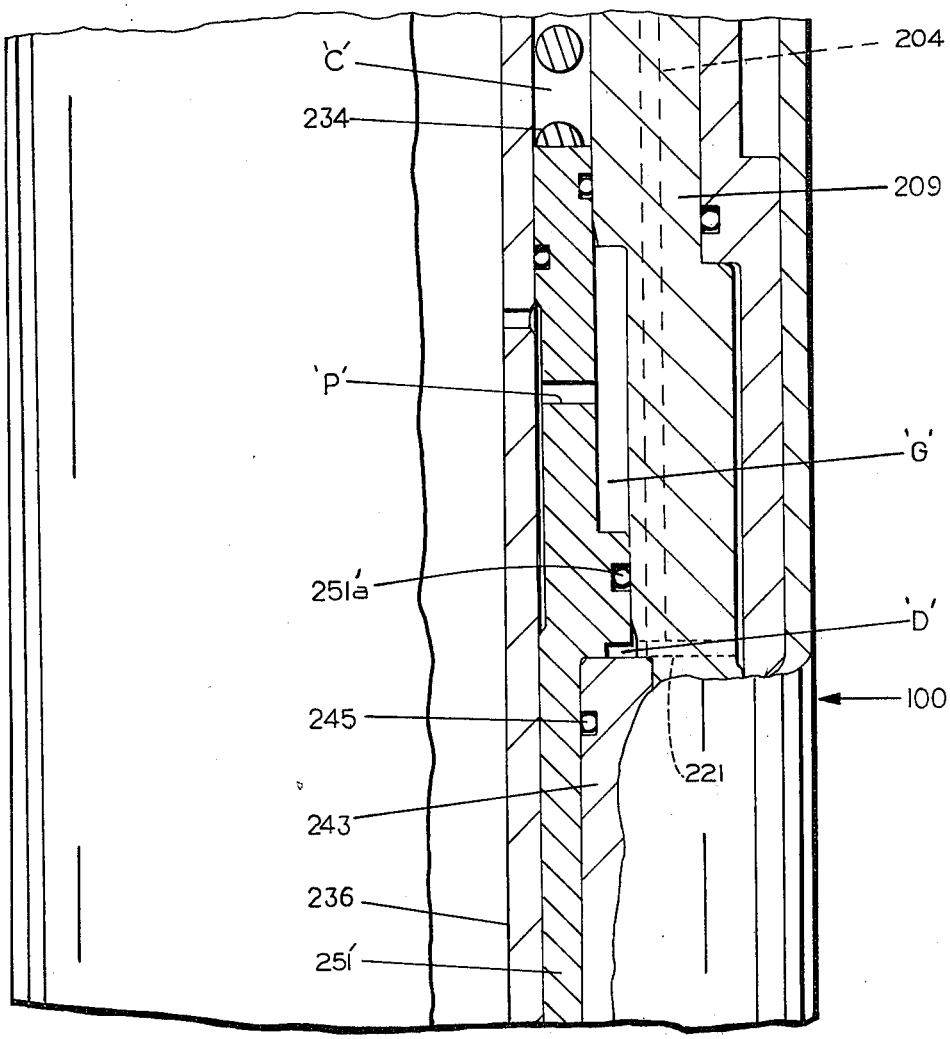
FIGS. 16A and 16B are elevational views, partly in section, of the apparatus of this invention embodying a modified construction of the inner latch retainer FIG. 16B being a vertical continuation of FIG. 16A.
Figure 16B:
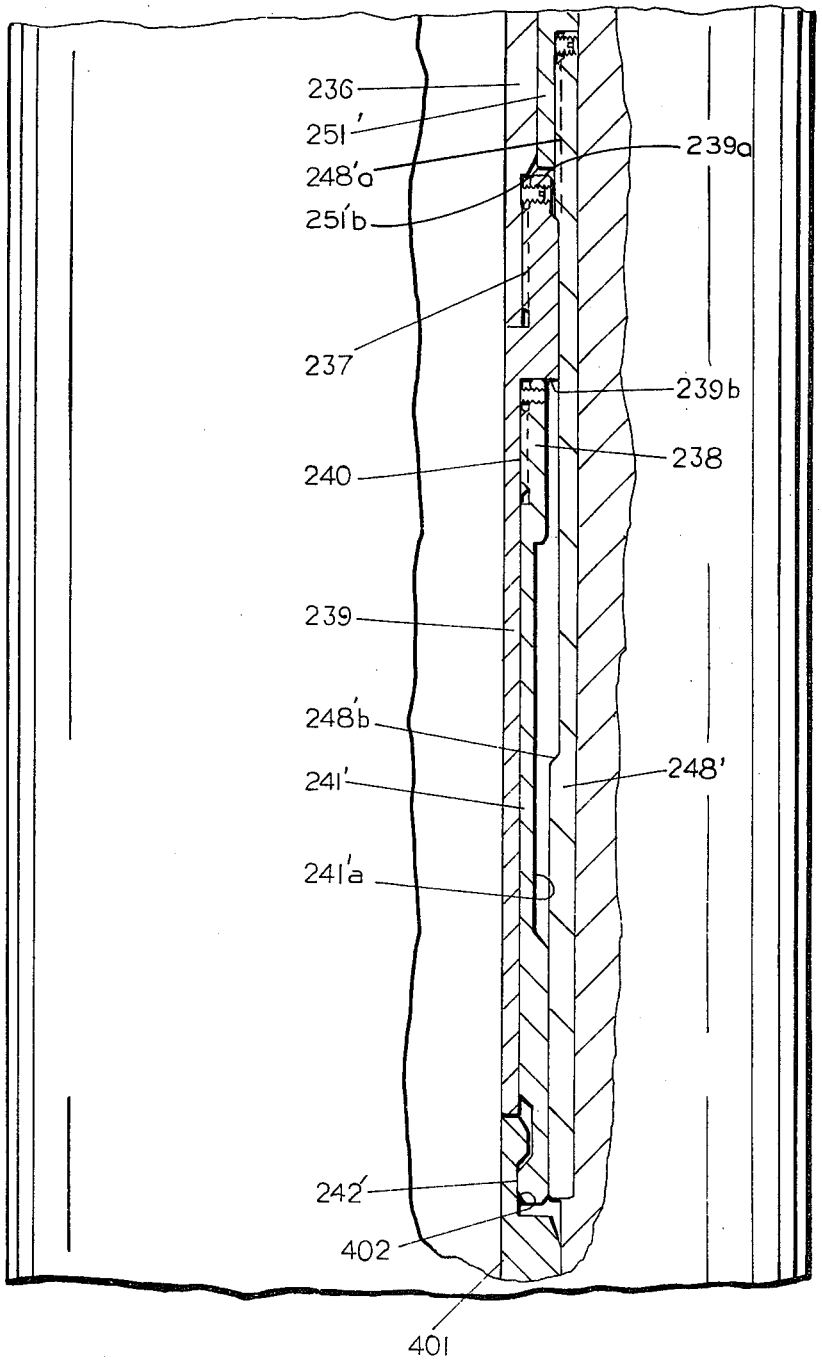

Referring now to FIGS. 16A and 16B, there is shown a modification of this invention involving the construction and operation of the inner latch mechanisms. In these figures, where similar numbers refer to components previously described, the inner latch fingers 242' have the same cooperative relationship with the profile groove 402 on the latch receptacle 401 as the fingers 242, and latch 241' is connected to the stinger 200 in the same manner as heretofore described. The latch 241' and the latch retainer 248' are, however, of modified construction, and the latch retainer spring 246 has been eliminated. The upper portions of the latch fingers 241' are inwardly recessed as indicated at 241'*a*. Thus, when the latch retainer 248' is moved upwardly relative to the latch fingers 242', when the bottom end of latch retainer sleeve 248' reaches a position adjacent the profile 241'*a*, the latch fingers 242' will be free to move outwardly relative to the profile groove 402 and the stinger 200 will be released for upward movement relative to the ball cartridge assembly 400 and receptacle 401. The latch retainer sleeve 248' is now directly connected by threads 248'*a* to the lower end of latch piston 251' which is slidable in chamber 'G'. The top of piston 251' provides a seat for the ball operator piston return spring 234. An equalizing port 'P' is provided in piston 251' above O-ring seal 251'*a*.

The fluid pressure operation of the latch retainer 248' is accomplished in a manner identical to that already described in connection with latch retainer 248. Namely, whenever, fluid pressure is applied through conduit 203 to chamber 'A' to open the ball valves, the latch finger portions 242' are moved downwardly by piston 236 relative to the latch retainer 248', but do not move sufficiently to bring the profile 241'*a* beyond the bottom end of the retainer 248', hence, the latch fingers 242' are not disengaged during the movement of the ball valves to their unlocked positions. As the piston 236 moves downwardly, it compresses the piston return spring 234 which also forces the latching piston 251' to be moved downwardly where it shoulders out against the stop sleeve 243. However, the latching fingers 242' remain trapped in the receptacle groove 402 provided on the ball cartridge housing 401. This locked relationship is also maintained during movement of the ball valves to their closed position resulting from an upward movement of the ball valve piston 236, which pulls with it the inner latch fingers 242' and the latch retaining sleeve 248' by virtue of the top end face 239*a* of latch mandrel 239 cooperating with the bottom end face 251'*b* of the latch piston 251'.

The major functional difference between the inner latch mechanism of FIGS. 16A and 16B is that the latch fingers 242' are held in engagement with groove 402 by latch sleeve 248' even when the ball valves are in their closed position.

In the fluid pressure actuated release procedure for the modified inner latch, the fluid control pressure is introduced into chamber 'C' through control line 204 and concurrently into chamber 'D' through port 221. Pressure in chamber 'C' forces the ball lock piston 236 upwardly. The control pressure in chamber 'D' forces the latch piston 251' to travel upwards, thus compressing the piston return spring 234, and further insuring that the ball actuating piston 236 is indeed in the fully upward position. Thus, the lock sleeve 241', including the latching fingers 242', is concurrently pulled upward.

The latch sleeve piston 251' and latch sleeve 248' will move upwards only until a profile 248'*b* hits a downwardly facing shoulder 239*b* provided on the latch mandrel sleeve 239. At this point, the latch fingers 242' are in a lowered position relative to the latch retainer sleeve 248' where profile 241'*a* is opposite the bottom end of sleeve 248', so that such fingers will snap out of their engagement with the profile groove 402, thus effecting the releasing of the inner latch mechanism. The outer latch assembly 300 is released in the same manner as heretofore described.

Additionally, the modification of FIGS. 16A and 16B functions in a different manner when it is necessary to resort to mechanical release of the inner and outer latch mechanisms by rotation of the tubing string T to the right. The outer latch mechanism 300 is released in the same manner as heretofore described. The inner latch mechanism, however, now requires releasing because now the outer latch sleeve 248' is trapping the latching fingers 242' in the profile 402 provided in the ball cartridge unit 400. However, if the stinger 200 is continued to be moved upwardly after release of the outer latch mechanism 300, the latch retaining sleeve 248' must move upwardly with the stinger 200 because it is connected to lock piston 251' which is moved upwardly by the sleeve 243. In doing so, the spring 234 is compressed because the ball operating piston 236 is being forced downwardly relative to the upward motion of the latch piston 251'. This then permits the latch retaining sleeve 248' to move upwardly relative to the latch fingers 242' till the profile 241'*a* on the top edge of the latch fingers 242' clears the bottom edge of the retaining sleeve 248', at which point the latch fingers 242' are now free to snap out of the latching profile 402 and the inner latch mechanism is then released. Immediately, the ball piston return spring 234 will force the ball operating piston 236 downwardly relative to the latch retaining sleeve 248' and into their original relative positions illustrated in FIGS. 16A and 16B.

From the foregoing description, it is readily apparent that the modified inner latch mechanism heretofore described, and illustrated in FIGS. 16A and 16B, permits the mechanical release of such latch mechanism without having to rely, in any manner, on the operation of fluid pressure or springs in order to effect the release. The reliability of the release is thus substantially enhanced.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a test assembly with a blowout preventer stack above a subterranean well and carryable between upper and lower portions of a tubular conduit extendible to at least one production zone within said well, said test assembly having valve means in the lower conduit portion manipulatable between open and closed positions by a reciprocable actuator sleeve to control the flow of fluid within said conduit, the improvement comprising: means defining an annular pressure chamber disposed around said actuator sleeve; an annular piston mounted in said annular fluid pressure chamber for shifting the actuator sleeve between its valve open and valve closed positions; latching means connecting said annular piston to said valve actuator; a latch retaining sleeve axially shiftably mounted in the upper tubular conduit portion between a latch retaining position securing said annular piston to said actuator sleeve, and a latch releasing position relative to said latching means releasing said annular piston from said actuator sleeve; means for maintaining said latch retaining sleeve in said latch retaining position whenever said valve means is positioned in other than its closed position; a second annular piston in said annular pressure chamber operatively connected to said latch sleeve, and a spring interposed between said annular piston and said second annular piston.

2. The apparatus of claim 1 wherein said latch retaining sleeve is shifted to a latch releasing position by upward movement relative to said latching means, and means for supplying fluid pressure to a downward face of said second annular piston to move said latch retaining means to said latch releasing position.

3. In a test assembly within a blowout preventer stack above a subterranean well and carriable between upper and lower portions of a tubular conduit extendible to at least one production zone within said well, said test assembly having valve means in the lower conduit portion manipulatable between open and closed positions by a reciprocable actuator to control flow of fluid within said conduit, the improvement comprising: an annular stinger body secured in depending relation to said upper conduit portion: an annular stinger receptacle secured in upstanding relation to said lower conduit portion above the valve means; means for slidably sealingly connecting the bottom portion of said stinger body to the top portion of said stinger receptacle, thereby permitting the selective connection and disconnection of said upper and lower conduit portions: an outer latching means surrounding said stinger body and said stinger receptacle and movable into a latching position to secure said stinger body and said stinger receptacle in sealing relationship; means for maintaining said outer latching means in said latching position whenever said valve means is positioned in other than its closed position; an annular piston concentrically mounted within said stinger body and operably connected to said valve actuator for shifting the actuator between its valve open and valve closed positions; inner latching means connecting said annular piston to said valve actuator; an inner latch retaining sleeve axially shiftably mounted in the upper tubular conduit between a latch retaining position and a latch releasing position relative to said inner latching means; and means for maintaining said inner latch retaining sleeve in said latch retaining position whenever said valve means is positioned in other than its closed position.

4. The apparatus of claim 3 wherein said maintaining means comprises a spring interposed between said annular piston and said latch retaining sleeve for urging said latch retaining sleeve to move concurrently with movement of said valve acutator sleeve toward said valve open position.

5. The apparatus of claim 4 wherein said annular piston is mounted in an annular pressure chamber disposed around said actuator sleeve, a second annular piston in said annular pressure chamber operatively connected to said latch sleeve, and said spring is interposed between said annular piston and said second annular piston.

6. The apparatus of claim 5 wherein said latch retaining sleeve is shifted to a latch releasing position by upward movement relative to said latching means, and means for supplying fluid pressure to a downward face of said second annular piston to move said latch retaining means to said latch releasing position.

7. The apparatus of claim 3 wherein said outer latch means comprises annular locking shoulders respectively carried on said stinger body and said stinger receptacle, said locking shoulders being in axial proximity when said stinger body is sealingly engaged with said stinger receptacle; a collet assembly shiftable between a position securing said locking shoulders against axial separation to a position permitting axial separation; a spring pressed collet actuating sleeve urging said collet assembly to said securing position relative to said locking shoulders: and fluid pressure responsive means for shifting said collet assembly to said position permitting locking shoulder separation.

8. The apparatus of claim 7 further comprising means responsive to rotation of said stinger body relative to said stinger receptacle for shifting said collet actuating sleeve upwardly to said shoulder separation permitting position: and means responsive to upward movement of said stinger body relative to said stinger receptacle for shifting said inner latch retaining sleeve to its releasing position, thereby permitting separation of the upper and lower conduit portions.

9. In a test assembly within a blowout preventer stack above a subterranean well and carriable between upper and lower portions of a tubular conduit extendible to at least one production zone within said well, said test assembly having valve means in the lower conduit portion manipulatable between open and closed positions to control flow of fluid within said conduit, the improvement comprising: an annular stinger body secured in depending relation to said upper conduit portion; an annular stinger receptacle secured in upstanding relation to said lower conduit portion above the valve means; means for slidably sealingly connecting the bottom portion of said stinger body to the top portion of said stinger receptacle, thereby permitting the selective connection and disconnection of said upper and lower conduit portions: an outer latching means surrounding said stinger body and said stinger receptacle and movable into a latching position to secure said stinger body and said stinger receptacle in sealing relationship; means for maintaining said outer latching means in said latching position whenever said valve means is positioned in other than its closed position; an annular actuator for said valve means reciprocably mounted within said annular stinger receptacle to move said valve means from a closed to an open position by downward movement of said actuator; an annular piston concentrically mounted within said stinger body and operably connected to said valve actuator for shifting the actuator between its valve open and valve closed positions; resilient means opposing downward movement of said annular piston; inner latch means connecting said annular piston to said valve actuator; an inner latch retaining sleeve axially shiftably mounted in said annular stinger body for movement between a latch retaining position and a latch releasing position relative to said inner latching means; and means for maintaining said inner latch retaining sleeve in said latch retaining position whenever said valve means is positioned in other than its closed position.

10. The apparatus defined in claims 3, 4, 5, 6 or 9 further comprising means responsive to rotation of said stinger body relative to said stinger receptacle for releasing said outer latching means; and means responsive to upward movement of said stinger body relative to said stinger receptacle for shifting said inner latch retaining sleeve to its said latch releasing position, thereby permitting mechanical separation of said upper conduit portion from said lower conduit portion.

* * * * *